US010220494B2

(12) United States Patent
Burke

(10) Patent No.: US 10,220,494 B2
(45) Date of Patent: Mar. 5, 2019

(54) TOOL ATTACHMENT SYSTEM

(71) Applicant: Craig Andrew Burke, Neutral Bay (AU)

(72) Inventor: Craig Andrew Burke, Neutral Bay (AU)

(73) Assignee: ROCKA DEVICES PTY. LTD. (AU)

( * ) Notice: Subject to any disclaimer, the term of this patent is extended or adjusted under 35 U.S.C. 154(b) by 0 days.

(21) Appl. No.: 15/168,121

(22) Filed: May 30, 2016

(65) Prior Publication Data

US 2017/0030512 A1 Feb. 2, 2017

Related U.S. Application Data

(63) Continuation-in-part of application No. 13/880,757, filed on Apr. 22, 2013, now Pat. No. 9,351,558.

(51) Int. Cl.

| | |
|---|---|
| ***B25B 23/00*** | (2006.01) |
| ***A45F 5/02*** | (2006.01) |
| *A45F 5/00* | (2006.01) |

(52) U.S. Cl.

CPC ..... *B25B 23/00* (2013.01); *A45F 5/021* (2013.01); *A45F 2005/006* (2013.01); *A45F 2005/008* (2013.01); *A45F 2005/025* (2013.01); *A45F 2005/028* (2013.01)

(58) Field of Classification Search

CPC ..... F16M 11/10; F16M 13/04; A45F 5/021; A45F 2005/006; A45F 2005/008; A45F 2005/025; A45F 2005/028; A45F 5/00; B25H 3/00

USPC ... 248/349.1, 125.7, 131, 415, 186.1, 186.2; 224/197; 24/3.12

See application file for complete search history.

(56) References Cited

U.S. PATENT DOCUMENTS

| | | | | |
|---|---|---|---|---|
| 1,650,802 | A | 11/1927 | McLoughlin | |
| 2,832,120 | A | 4/1958 | Jayet | |
| 3,621,651 | A | 11/1971 | Gillespie | |
| 3,789,467 | A | 2/1974 | Aratani et al. | |
| 4,681,039 | A | 7/1987 | Perrin | |
| 5,267,377 | A | 12/1993 | Gillis et al. | |
| 6,308,385 | B1 | 10/2001 | Ball | |
| 7,614,532 | B1 * | 11/2009 | Dague | A45F 5/02 224/148.7 |
| 2009/0241305 | A1 | 10/2009 | Buckingham | |
| 2010/0147912 | A1 | 6/2010 | Salentine | |
| 2010/0206922 | A1 * | 8/2010 | Gross | A45F 5/004 224/162 |

FOREIGN PATENT DOCUMENTS

| | | |
|---|---|---|
| JP | 54149232 | 6/1981 |
| JP | H0673895 | 3/1994 |

* cited by examiner

*Primary Examiner* — Christopher Garft

(74) *Attorney, Agent, or Firm* — Galbreath Law Offices, P.C.; John A. Galbreath

(57) ABSTRACT

An attachment device (10) adapted for use with at least two retainers (14), the device (10) including at least two mountings (44), each for engagement with a retainer (14), wherein when a first one (14*a*) of the retainers is engaged with the device (10) it cannot be detached from the device until another retainer (14*b*) has been engaged with the device (10).

12 Claims, 23 Drawing Sheets

TOOL ATTACHMENT SYSTEM

FIELD OF INVENTION

This invention relates to tool holders and more particularly to securely retaining tools and other implements when working above ground or water so as to prevent accidental dropping of such items. However, the invention is not limited to such uses.

BACKGROUND

When working with tools and other objects above ground there is always a risk that an item will be accidentally dropped. A relatively small object can cause serious injury or even death if it falls on a person below or significant damage to property.

The present invention aims to provide a system that reduces and preferably prevents accidental dropping of objects.

SUMMARY OF THE INVENTION

In one broad form the invention provides an attachment device adapted for use with at least two retainers, the device including at least two mountings, each for engagement with retainer, wherein when a first one of the retainers is engaged with the device it cannot be detached from the device until another retainer has been engaged with the device.

In a preferred form the device is provided with two mountings.

In a preferred form the device includes a latch mechanism that, for each mounting, includes a portion movable between first and second positions. In a preferred form a portion of the latch mechanism is in the first position for a first mounting when another portion of the latch mechanism in a second position for a second mounting.

The latch mechanism is preferably a structure that moves as one (whether formed as one part or of multiple components) but may be formed of two or more components that move relative to each other.

In a preferred form in the first position a retainer in a first mounting to the device is secured whilst a retainer in at least one other mounting is free to be attached or detached from the device.

In a preferred form in a position intermediate the first and second positions retainers engaged with at least two mountings are preferably secured to the device and none cannot be removed until a portion of latch mechanism has moved to the first position of at least one mounting.

In a preferred form the latch mechanism includes a member that rotates about an axis of rotation between the first and second positions. The member may move between the first and second positions by non rotary motion, such as by linear sliding motion.

Preferably the device includes a bias member to bias the latch mechanism or portions of the latch mechanism to the first or second positions. Preferably the bias member is more biased at an intermediate position than the first and second positions, i.e. there is an over centre action.

Preferably the latch mechanism is configured such that movement of a retained retainer draws the respective portion of the latch mechanism further away from the intermediate position.

In a preferred form the device includes two slot like mountings into each of which a retainer may be received. When a slot is open at a first end to receive a retainer preferably a first portion of the latch mechanism extends into the slot remote from the first end against which the retainer bears as it is passed into the slot. Continued motion of the retainer into the slot causes the latch mechanism to move to pass a second portion of the latch mechanism across the slot between the retainer and the first end, thereby closing the slot.

Preferably first portion of the latch mechanism presents a face angled to the slot.

Preferably the second portion of the latch mechanism presents a face angled to the slot against which the retainer may bear.

Preferably each slot is closed at a second end such that entry and exit of a retainer from the slot is via the first end. However, one or more slots open at both ends may be provided with a latching mechanism configured to allow entry and exit from either end.

In a preferred form the device has a latch with a head and a tail and is mounted for rotation about an axis intermediate the head and tail. Two blind slots extend either side of the axis and the latch rotates between first position and second positions. In either first or second position the head extends across a first one of the slots remote from the end, so as to close the first slot and retain any retainer in that first slot and the tail extends across the other slot remote from the open end. When a retainer is passed into the open slot it engages the tail and causes the latch to rotate to the other of the first and second positions, with the head extending across the second slot and not the first slot. Preferably at an intermediate position the head extends across both slots and prevents removal of a retainer located in either slot between the blind end and the head for being removed.

In another broad form the invention provides an attachment device adapted for use with at least two retainers, the device including:

- at least two mountings, each for engagement with a retainer, each mounting, including at least one latch portion movable between a retaining position in which the at least one latch portion prevents removal from the mounting of a retainer engaged with, retained by or otherwise restrained by the mounting and an open position in which a retainer may be disengaged from the mounting;
- each mounting also including at least one release portion for causing at Least one latch portion of at least one other mounting to move from a retaining position to an open position.

The or each mounting may include a volume into which a retainer is received. The or each volume may include an opening through which a retainer passes during engagement and disengagement with the mounting.

The at least one latch portion may extend into the volume when in the retaining position. The at least one latch portion may extend into the volume intermediate the retainer and the opening when in the retaining position.

The at least one release portion may extend into the volume when in the first position. The at least one release portion may extend into the volume and the retainer is intermediate the opening and the release portion.

The at least one release portion for at least one latch portion of a first mounting may extend into the volume of another mounting when the at least one latch portion is in the retaining position. A latch portion of a first mounting may be in the retaining position when a latch portion of a second mounting is in an open position.

Movement of a latch portion of a first mounting between the retaining position to an open position may occur with movement of a latch portion of a second mounting between the retaining position to an open position.

Latch portions of at least two mountings may be constrained to move as one.

The attachment device may include at least one latch member. The at least one latch member may have at least one latch portion. The at least one latch member may have at least one release portion. Latch portions of at least two mountings may be located on a single latch member. Release portions of at least two mountings may be located on a single latch member. Latch portions of at least two mountings may be located on different latch members. Release portions of at least two mountings may be located on different latch members.

The or each at least one latch member may be mounted for rotation about a respective axis of rotation. There may be at least two latch members, each Latch member having at least one latch portion and at least one release portion.

There may be at least two latch members mounted for rotation about a common axis.

In the first position a retainer in a first mounting to the device may be secured whilst a retainer in at least one other mounting is free to be engaged or disengaged from the device.

When corresponding latch portions are in a position intermediate the retaining and open positions, retainers engaged with at least two mountings may be secured to the device and none cannot be removed until one of the latch portions has moved to the first position of at least one mounting.

The device may include at least one bias member to bias at least one latch portion to a retaining position. The at least one bias member may be less biased when a latch portion is in at least one of the retaining or open positions than when the latch portion is intermediate the retaining or open positions.

Movement of a retainer engaged with a mounting may draw a latch portion further toward the retaining position. The latch portion drawn further toward the retaining position may be associated with the mounting in which the retainer is retained. The latch portion drawn further toward the retaining position may be associated with a mounting different to that in which the retainer is retained.

The at least one mounting may constrain the retainer to move along a path. The at least one latch portion may presents a corresponding face angled to the path, against which the retainer may bear. The at least one release portion may presents a corresponding face angled to the path, against which the retainer may bear.

The device may include at least one slot like mounting into each of which a retainer may be received. At least one slot may be closed or substantially closed at a second end such that entry and exit of a retainer from the slot is via the first end. At least one slot may be open at both ends and at least one of the at least one latch portion and the at least one release portion configured to allow entry and exit from either end.

The device may have:

at least one latch with at least one head and at least one tail and mounted for rotation about a respective axis intermediate the head and tail;

the at least one head comprising at least one latch portion;

the at least one tail comprising at least one release portion;

at least two blind slots extending either side of the axis;

the at least one latch rotatable between first and second positions;

wherein in either first or second position a head extends across a first one of the slots remote from the end, so as to close the first slot and retain any retainer in that first slot and the tail extends across a second slot remote from the open end, and when a retainer is passed into the second of said slots it engages the tail and causes the latch to rotate to the other of the first and second positions, with the head extending across the second slot and not the first slot.

In another broad form the invention provides an attachment system that includes an attachment device in all forms of the invention together with one or more retainers.

In another broad form the invention provides a rotatable dock for a retention system or device, the dock comprising:

a retainer member comprising a retention portion adapted to be trapped by the retention system, and a mounting member adapted to be mounted on an object;

the retainer member mounted on the mounting member for rotation about an axis, and a detent mechanism that resists relative rotation of the mounting and retaining members.

One of the mounting and retaining members may comprise a mating phortion having a first surface and a second surface, the other of the mounting and retaining members having at least one first portion that engages the first surface and at least one second portion that engages the second surface.

The mating member may comprise at least one annular ring portion centred on the axis.

The mating member may comprise an opening and the other of the mounting and retaining member may extend through the opening. The other of the mounting and retaining member may also extend around the mating member, either as an alternative to or in addition to extending through the opening.

The rotatable dock may include at least one slot or recess in the mating portion.

The rotatable dock may include at least one securing portion that engages one or both of the first and second surfaces, the securing portion and/or the mating portion adjacent the at least one slot or recess being deflectable to allow the at least one securing portion to pass through the slot or recess.

The at least one securing portion may comprise two diametrically opposed securing portions.

The at least one securing portion may comprise two spaced apart wall portions or may be attached to two spaced apart wall portions.

The wall portions may be deflectable.

The two spaced apart wall portions may be angled toward each other.

The rotatable dock may include a cross member that connects the two wall portions to limit or prevent deflection.

The rotatable dock may have:

the mounting member comprising a mating member having an opening, a first annular surface on one side of the opening and a second annular surface on the other side of the opening, and the retainer member comprising two wall portions, each wall portion engaging the first annular surface and having a securing member that extends through the opening and extends over and engages the second annular surface;

the detent formed by at least one first detent member on at least one securing member that engages at least one second detent member on the second annular surface.

The mating member may comprise two slots to allow the two wall portions and/or the securing members to pass through the mating member.

The rotatable dock may have:

the retainer comprising a recess defining a part of a cylindrical recess and the mounting member comprising a mating member received in the recess, the mating member having one or more peripheral edge portions that extend circumferentially about the axis;

the retainer comprising securing tabs that extend inwards over the mounting member to secure the mounting member in the recess.

The mating member may comprise two slots to allow the securing members to pass around the mating member.

The securing tabs may include detent members that engaged complementary detent members on the mounting member.

The invention also includes the combination of at least one rotatable dock as described and an attachment device adapted to receive the dock, the device including:

a first elongate slot having an open first end, the first slot adapted to receive a retention portion of a first rotatable dock via the open first end;

a second elongate slot having an open second end, the second slot adapted to receive a retention portion of a second retainer via the open second end;

a first latch portion and a second latch portion;

a first release portion having a first engagement surface, and a second release portion having a second engagement surface, wherein the first latch portion and the second release portion are connected together for rotation about a first axis;

the second latch portion and the first release portion are connected together for rotation about a second axis;

the first latch portion and second release portion are connected to the second latch portion and first release portion;

the first latch portion is rotatable about the first axis between a first retaining position and a first open position and, in the first retaining position the second engagement surface is located in the second slot at a second release position remote from the second end, and at least part of the first latch portion extends into or across the first slot to substantially block the slot, and in the open position the first slot is not blocked by the first latch portion;

the second latch portion is rotatable about the second axis between a second retaining position and a second open position, and in the second retaining position, the first engagement surface is located in the first slot at a first release position remote from the first end, and at least part of the second latch portion extends into or across the second slot to substantially block the slot, and in the open position the slot is not blocked by the second latch portion, and when in the first retaining position the first latch portion is located between the first end and the first release position, and when in the second retaining position the second latch portion is located between the second end and the second release position, and movement of the first engagement surface away from the first release position and away from the first open end causes the second latch portion to move from the second retaining position toward the second open position and causes or urges movement of the first latch portion toward the first retaining position;

movement of the second engagement surface away from the second release position and away from the second open end causes the first latch portion to move from the first retaining position toward the first open position and causes or urges movement of the second latch portion toward the second retaining position;

and when one of the first and second latch portions is between the respective open and retaining positions, the other of the first and second latch portions extends into the respective first or second slot.

Unless the context clearly requires otherwise, throughout the description and the claims the words 'comprise', 'comprising', and the like are to be construed in an inclusive sense as opposed to an exclusive or exhaustive sense; that is to say, in the sense of "including, but not limited to".

DETAILED DESCRIPTION OF PREFERRED AND OTHER EMBODIMENTS

Referring to FIGS. 1 to 7 there is shown a safety tool attachment system 10 according to one implementation of the invention. The system includes a tool mounting 12 and two retainers 14*a*, 14*b*.

The tool mounting 12 may be attached directly to a tool 15 or may be attached via tether 16.

Figure 1:
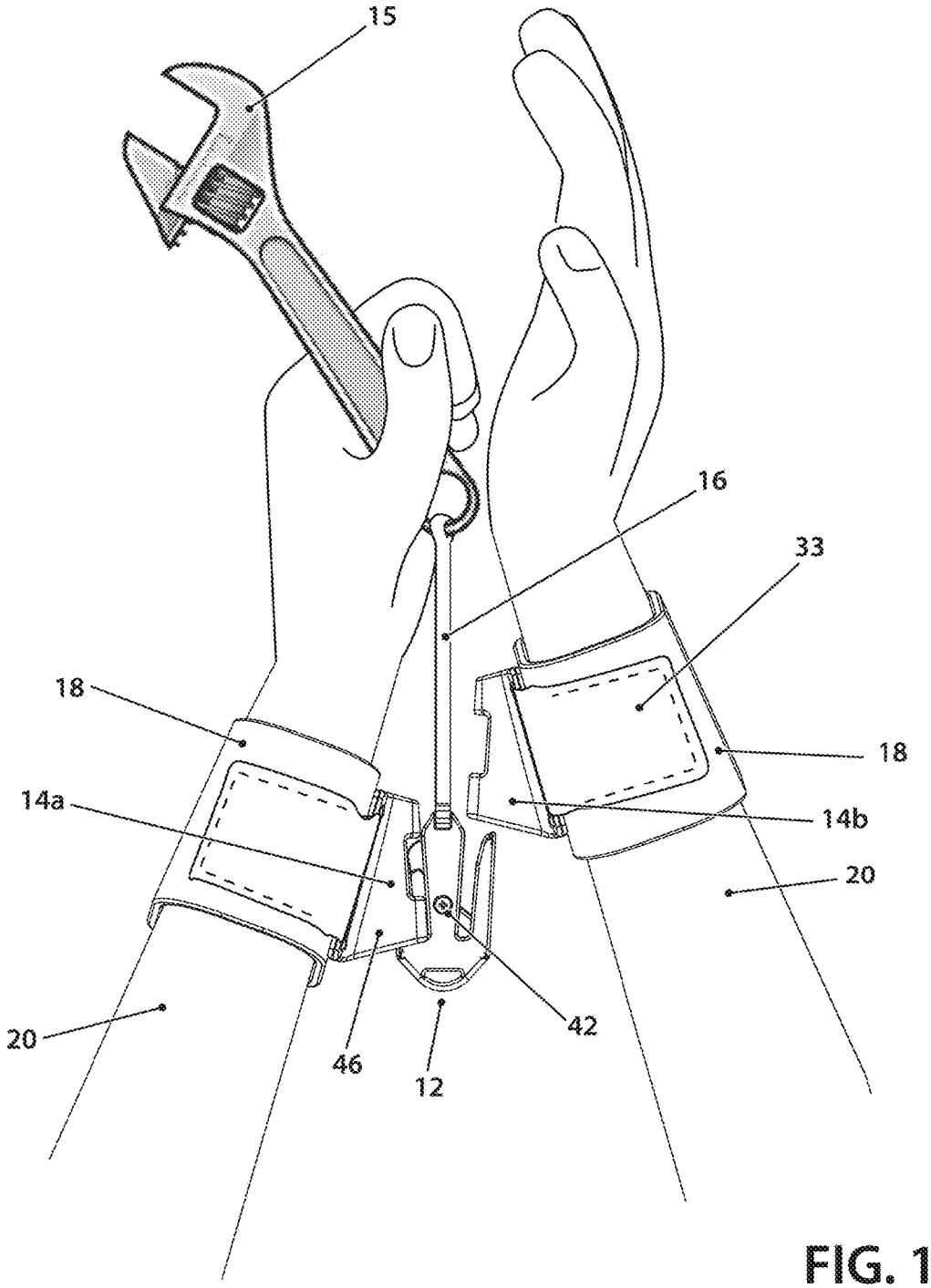
FIG. 1 is a schematic perspective view of an attachment system according to an embodiment of the invention.
Figure 2:
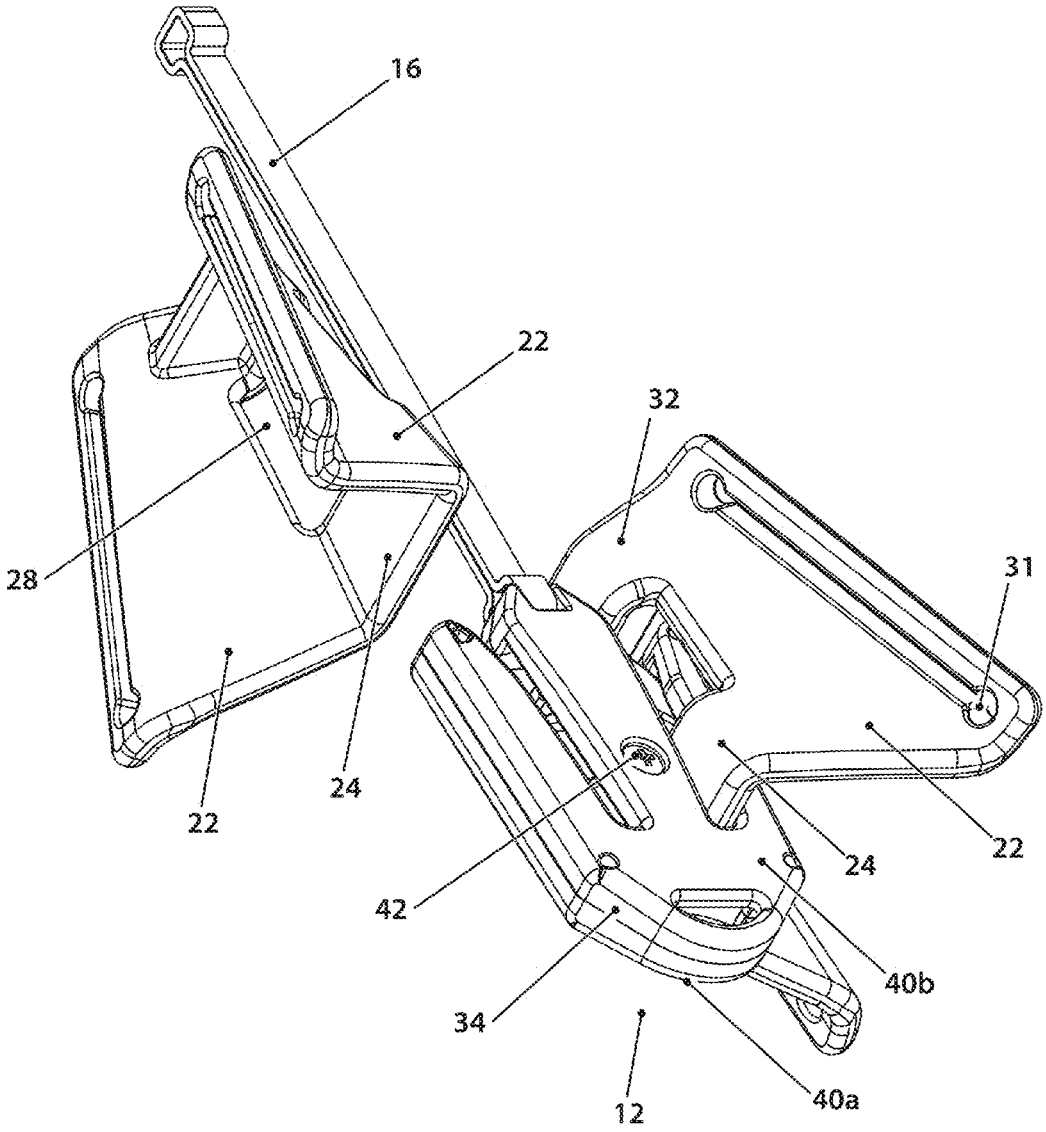
FIG. 2 is a perspective view of the components of FIG. 1 with a mounting engaged with a first retainer.

The retainers 14 are mounted to a suitable object. In FIG. 1 the retainers 14 are mounted on wrist straps 18 which in turn are mounted on the arms 20 of a user. The retainers 14 have slots 31 through which a strap may pass, such as strap 33 of wrist straps. The slots 31 are also shaped so that a screw, bolt, rivet or similar fastener may pass through at either end into a solid object, such as a post or other suitable structure.

The retainers 14*a*, 14*b* are identical to each other each and have two spaced apart side plates 22 joined by rib 24. Openings 26 and 28 are thus located either side of rib 24. Additional rib 32 serves to space and join two side plates 22 together and delineate the opening 28. The rib 24 is generally elongate and linear. The rib 24 may also be circular in cross-section.

The tool mounting 12 includes a housing 34 with a latch 36 pivotably mounted on axle 38. The housing 12 may be formed of two side plates 40*a* and 40*b* joined together. A screw 42 may serve to hold the two plates 40*a* and 40*b* together and function as the axle 38. The housing 12 defines two elongate slots 44 extending either side of axle 38.

The latch 36 is elongate and symmetrical about its longitudinal axis and includes an arrow shaped head 46 at one end and a tail 48 at the other end, with axle 38 located in between. Tail 42 has two faces 50 and 54 angled to each other and the longitudinal axis. The housing 12 includes leaf spring 52 that engages one or other of the faces 50 and 54 and serves to bias the latch 36 to be pivoted to one or the other sides of the axis of the housing. The angled nature of the faces 50 and 52 provides an over centre action that causes the Latch 36 to "flip" from one side to the other when rotated and serves to bias the latch 36 to whichever current position it holds. Other over centre action mechanisms may be used.

The slots 44 are sized to receive rib 24 of a retainer 14.

Figure 3:
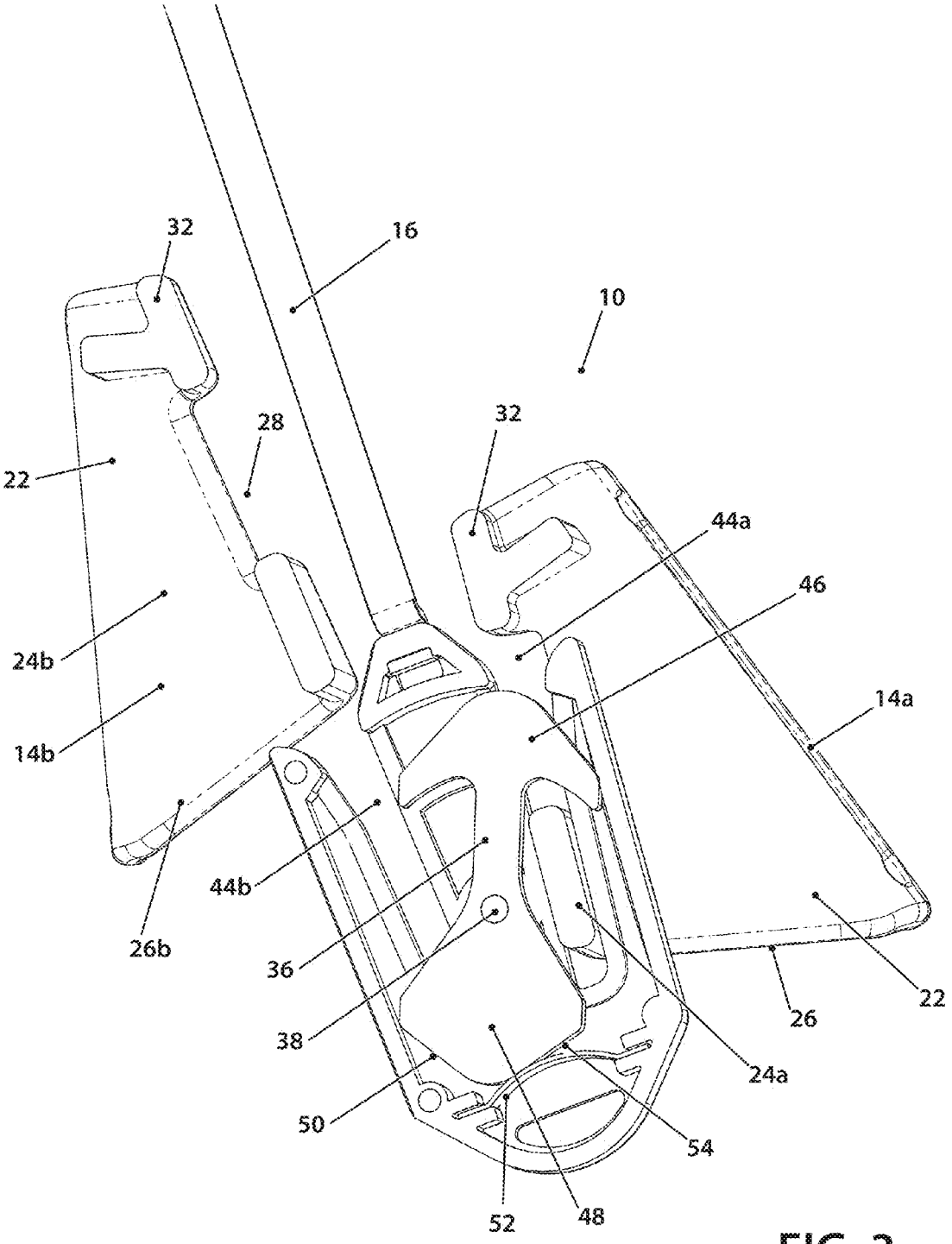
FIG. 3 is a sectioned view of the components of FIG. 1 with a mounting engaged with a first retainer.
Figure 4:
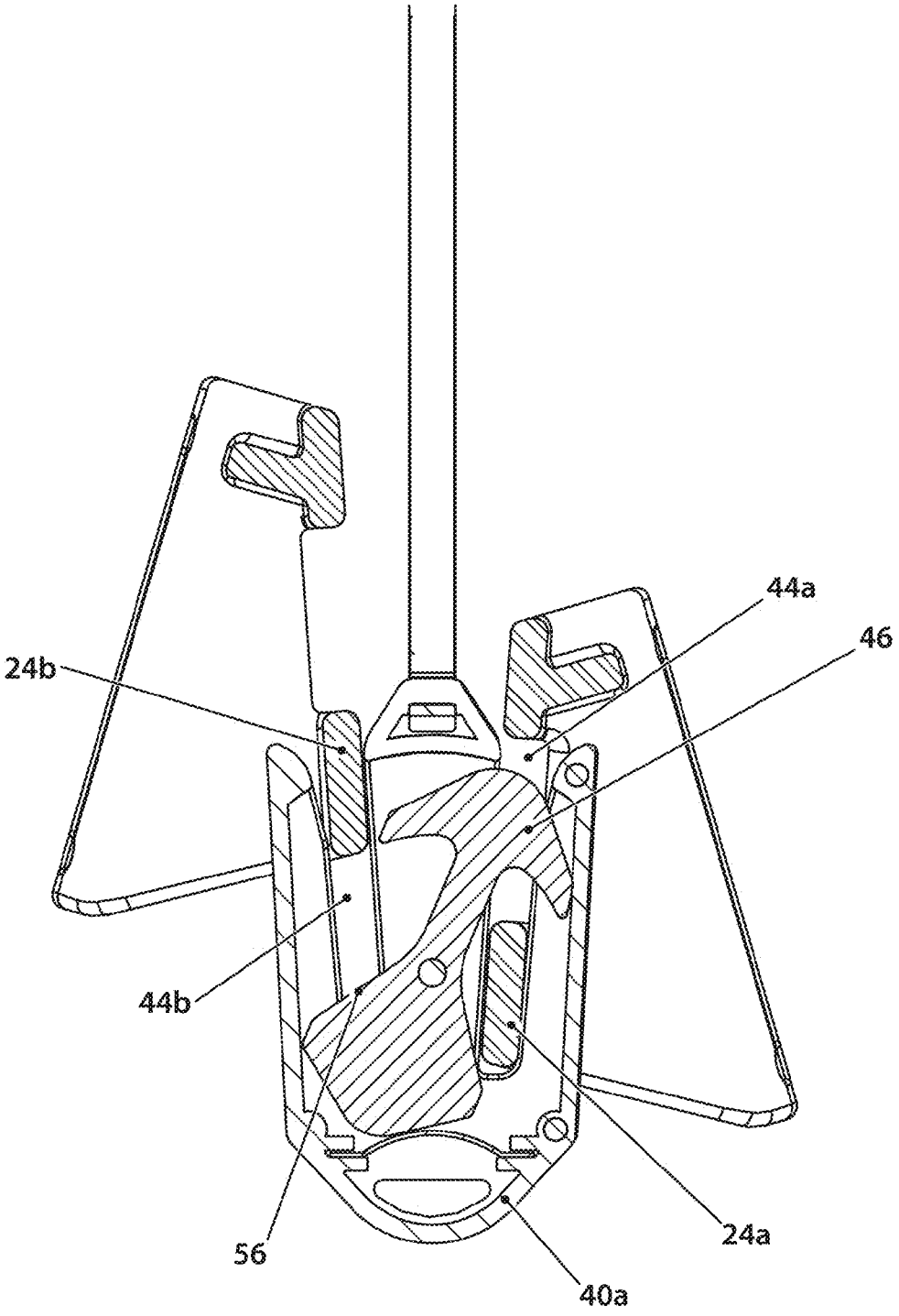
FIG. 4 is a sectioned view of the components of FIG. 1 with a mounting engaged with a first retainer and with a second retainer entering the mounting.

The arms 47*a* and 47*b* of the arrow shaped head 46 act as first and second latch portions, respectively. As seen in FIGS. 3 and 4 the latch 36 is oriented with head 46, and more particularly the arm 47*a* (first latch portion), extending over slot 44*a* and traps rib 24*a* between the arm 47*a* and the blind end of the slot 44*a*. Because rib 24*a* is connected to side plates it cannot be removed sideways from the slot. The rib is trapped in the slot 44*a* and so the tool mounting 12 is secured to the retainer 14*a* whilst the head, and more particularly the arm 47*a* (first latch portion), overlays the slot 44*a*. The latch 36 is maintained in this position by the spring 52.

The tail 48 can be considered to comprise first release portion 49*a* with a first angled engagement surface 56*a* and a second release portion 49*b* with a second angled engagement surface 56*b*. first angled engagement surface 56*a* extends into the slot 44*a*. Relative movement of the rib 24*a* along the slot 44*a* toward the tail will cause the latch 36 to rotate so as to cause more of head 46 to extend over the open end of slot 44*a*. Movement of rib 24*a* toward the open end of slot will cause the rib 24*a* to engage angled face 58*a* of arm 47*a* (first latch portion) and also cause more of head 46 to extend over the open end of slot 44*a*. Thus movement in either direction along slot 44 increases retention of the rib in the slot.

Slot 44*b* is open and the mounting 12 may be moved relative to retainer 14*b* so that rib 24*b* enters slot 44*b*. The head 46, and more particularly the arm 47*b* (second latch portion), does not impede the rib 24*b*. However, preferably the front faces 60 of the head are angled so that if they did extend into the slot entry of a rib will push them sideways and allow entry of the rib. The rib 24*b* moves into the slot and engages second engagement surface 56*b* of tail. The second engagement surface 56*b* is angled such that continued movement of the rib 24*b* toward the base of the slot 44*b* causes the latch 36 to rotate against the biasing force of the spring. Rotation continues until the tail 48 passes over the centre point and "flips" to the other orientation, with the head 46, and more particularly the arm 47*b* (second latch portion), extending over slot 44*b*. The length of the rib relative to the spacing of the head and tail is such that the rib 24*b* is located past the head and does not impede the rotation of the latch.

Figure 5:
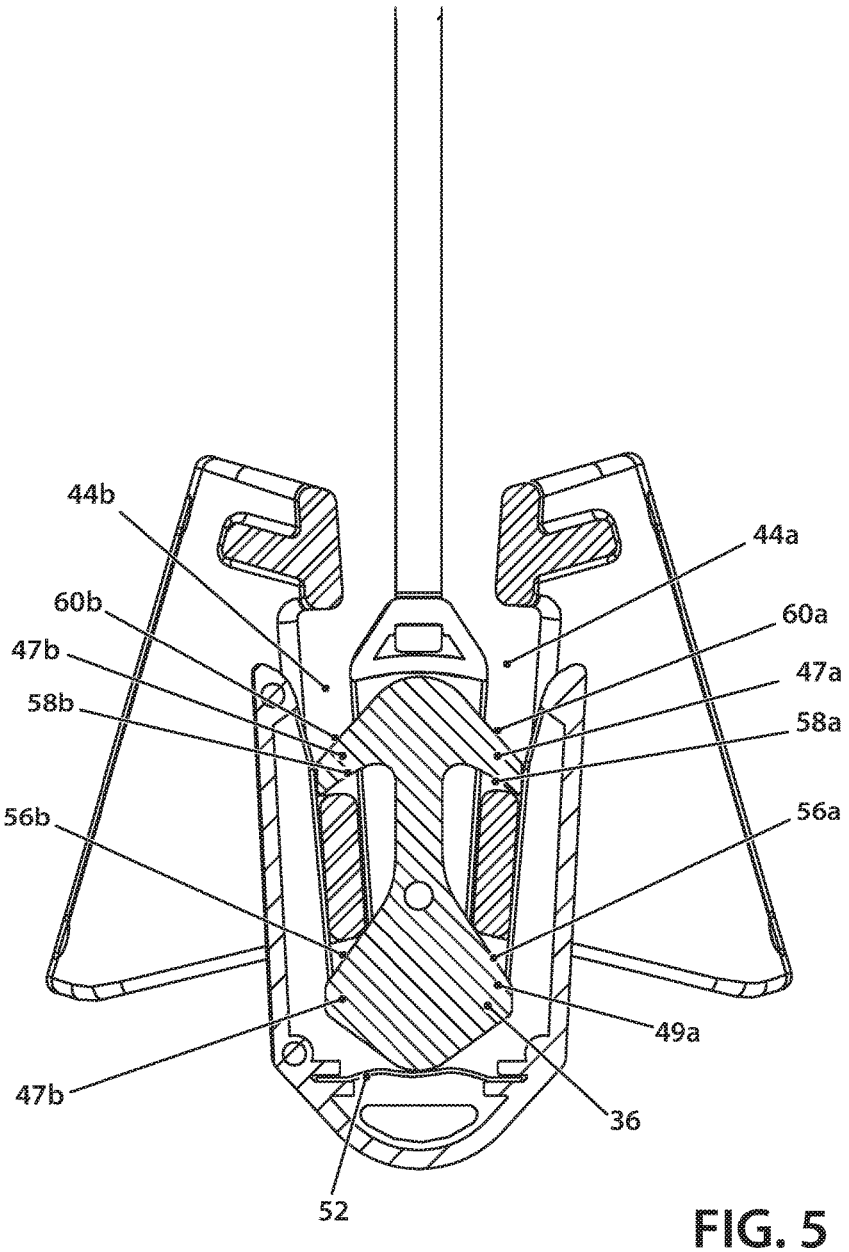
FIG. 5 is a sectioned view of the components of FIG. 1 at an intermediate state with the mounting engaged the first and second retainers.
Figure 6:
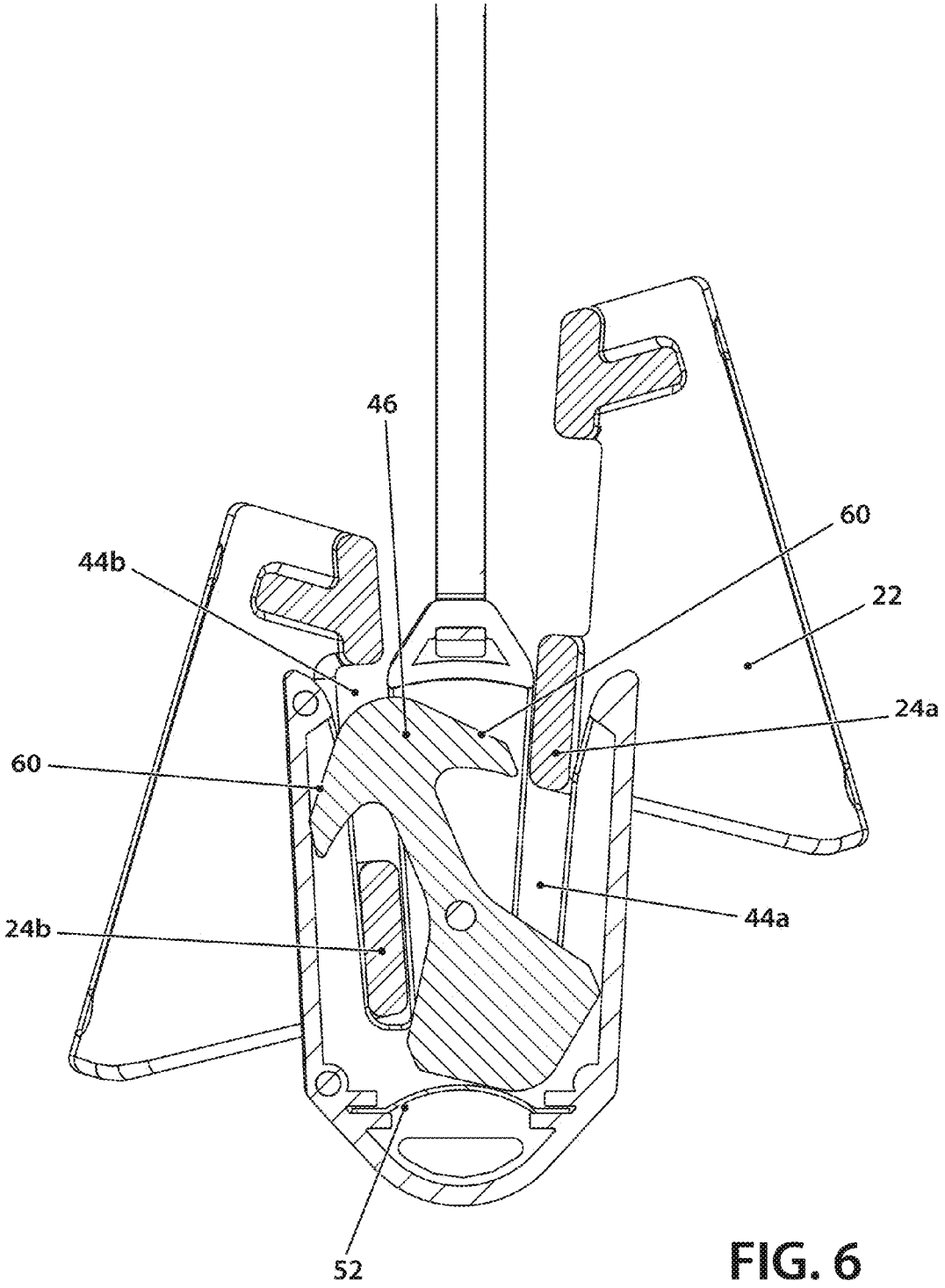
FIG. 6 is a sectioned view of the components of FIG. 1 with the mounting fully engaged the second retainer and the first retainer being removed from the mounting.

Referring to FIG. 5, at the centre position, the head 46, and more particularly both of the arms 47*a* and 47*b* (first and second latch portions), extends over both slots 44*a* and 44*b* and the tool mounting 12 is secured to both tool retainers 14*a* and 14*b*.

When the latch flips so that head covers slot 44*b* and traps rib 18*b*, the arm 47*a* (first latch portion) uncovers slot 44*a* and so rib 24*a* may be moved out of the slot 44*a* and engagement with the housing, as seen in FIG. 5. The tool holder 12 is now secured to retainer 14*b* and not to retainer 14*a*.

Thus the tool holder 12 remains attached to at least one retainer at all times. As such, so long as the retainers are suitably retained a tool attached to the tool holder cannot be dropped.

Figure 7:
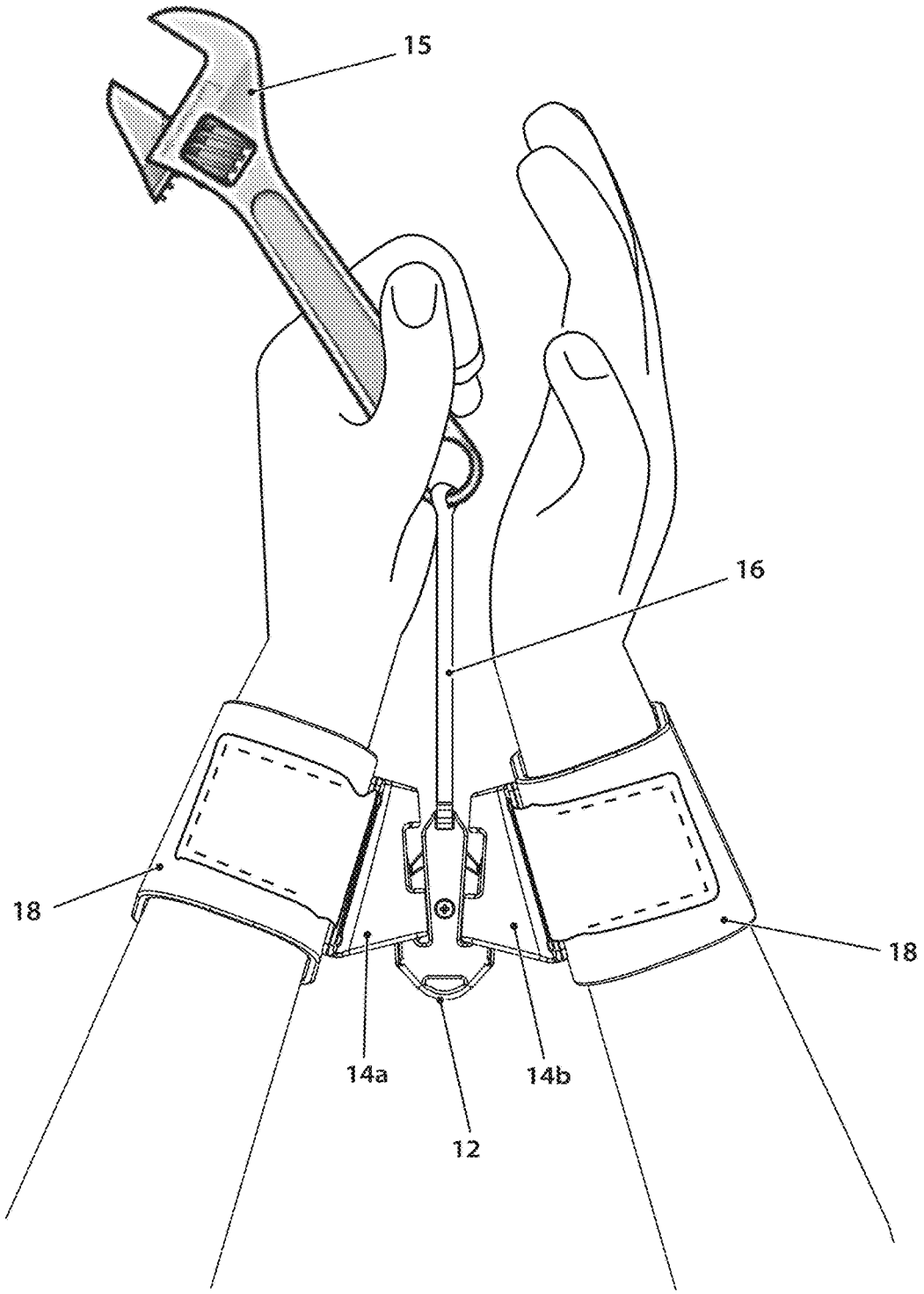
FIG. 7 is a perspective view of the system with retainers mounted on arms of a user and in the state of FIG. 5.

FIG. 7 schematically shows an arrangement corresponding to FIG. 5 in which both retainers 14*a*, 14*b* are secured to the tool holder.

Figure 8:
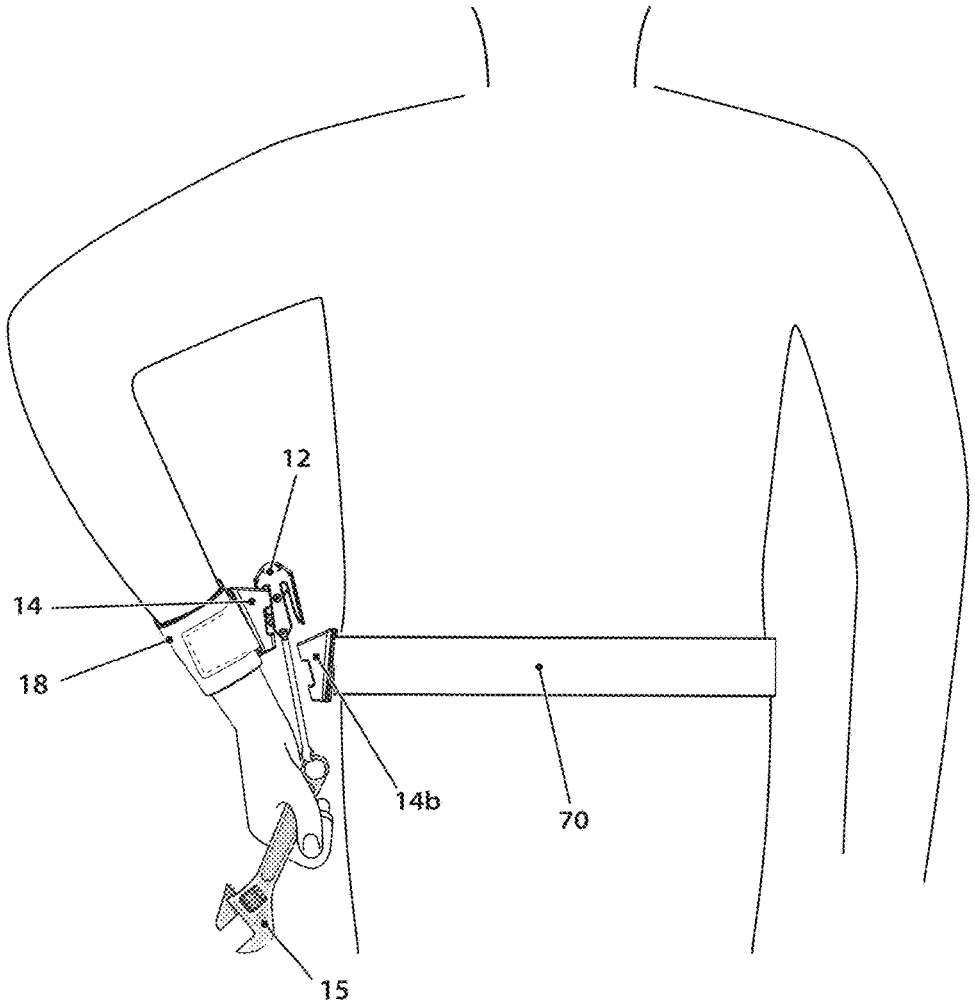
FIG. 8 is a perspective view of the system with a retainer mounted on a waist belt of a user.

FIG. 8 schematically shows an arrangement in which a retainer 14*a* is mounted on a wrist strap 18 and another retainer 14*b* is secured to a belt 70 on a user's torso. A tool holder 12 may be transferred from the user's arm 20 to the belt 70 as described above. The belt 70 may be provided with multiple retainers 14 with a tool secured to each retainer. Since each tool holder 12 must be engaged with another retainer before it can be disengaged from the waist belt 70, it is not possible to have one or more loose unsecured tools. The user may have more than one retainer on each arm and may have retainers on both arms. Thus if a user needs to work with a tool held in their left hand, the tool holder 12 may be secured to a retainer on the left arm. If use with the right arm is desired the tool holder 12 can be transferred from the left arm retainer to the right arm retainer using the process described above.

A work platform or similar may be provided with one or more tool retainers 14 such that tools may be securely attached to the work platform when not being used. When the user requires a tool the tool holder 12 is transferred from the retainer on the work platform to a retainer secured to the user.

Whilst the drawings show the user's retainers mounted directly on wrist or waist belts, this is not essential. It is merely necessary that the retainer be secured to the user. As an example one or more retainers may be attached to a user or work platform by rope or cable or other tethers. However, using wrist and waist belts provides a relatively rigid mounting and aids in engaging a "free' retainer with the captive holder.

Figure 11:
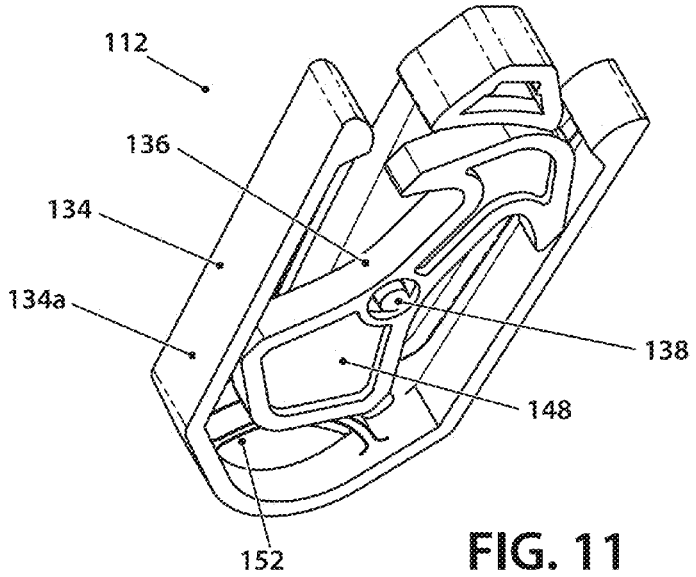
FIG. 11 is a sectioned perspective view of the tool mounting of FIG. 9.
Figure 9:
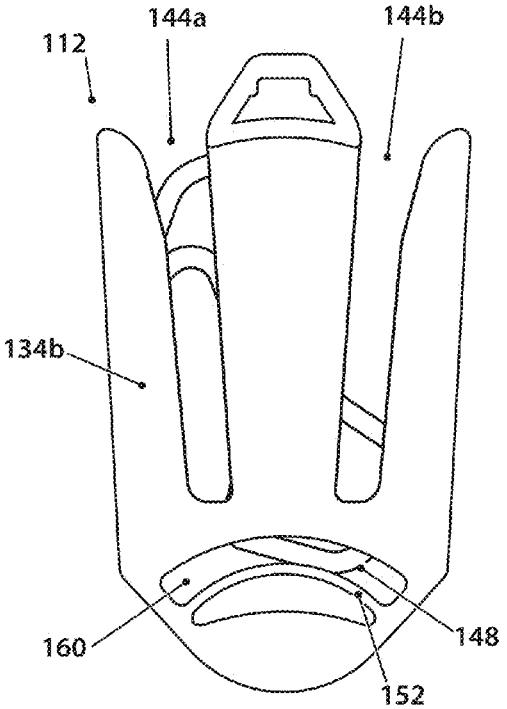
FIG. 9 is a side view of a tool mounting according to a second implementation of the invention.
Figure 10:
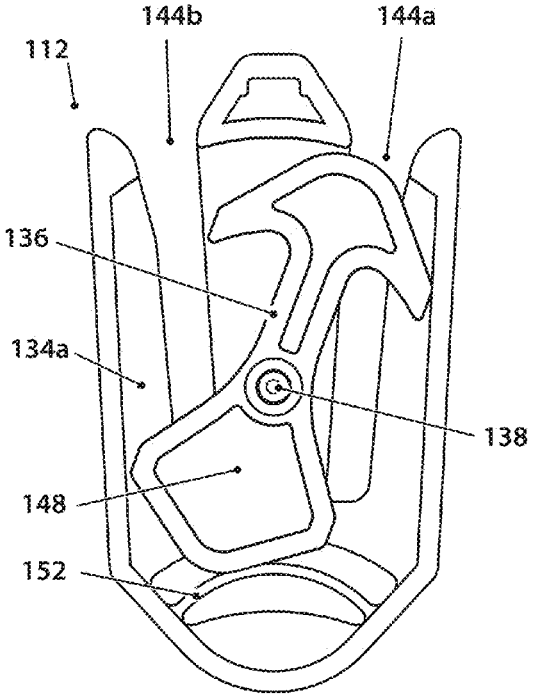
FIG. 10 is a sectioned side view of the tool mounting of FIG. 9.

FIGS. 9 to 11 show a tool mounting 112 similar to the tool mounting 12 of FIGS. 1 to 8. The tool mounting 112 operates substantially identically to tool mounting 12 and has latch 136 pivoting about axle 138 to alternatively cover the end of slots 144*a* and 144*b*. The axle 138 may be formed as part of one of the housing parts 134*a*, 134*b* and the latch 136 may be a press fit onto the axle. The latch 136 is biased to be over one of the slots 144*a* and 144*b* by spring member 152. The spring member 152 is preferably formed of a resilient plastics and integrally formed with housing part 134 but may be a separate component, whether metal, plastics or otherwise. One or both of the housing parts 134*a*, 134*b* are provided with a slot 160 that exposes part of the tail 148 of the latch 136. As best seen in FIG. 9, the slot extends either side of the tail. This slot provides the ability to manually release the mounting 112 from a retainer (not shown) held in one of the slots 144*a* and 144*b*. To do so the user may insert an implement, such as a screwdriver, into the slot 160 and engage the tail 148 to rotate the latch against the biasing force of spring so that the head moves from covering the end of one slot to covering the end of the other slot.

Figure 12:
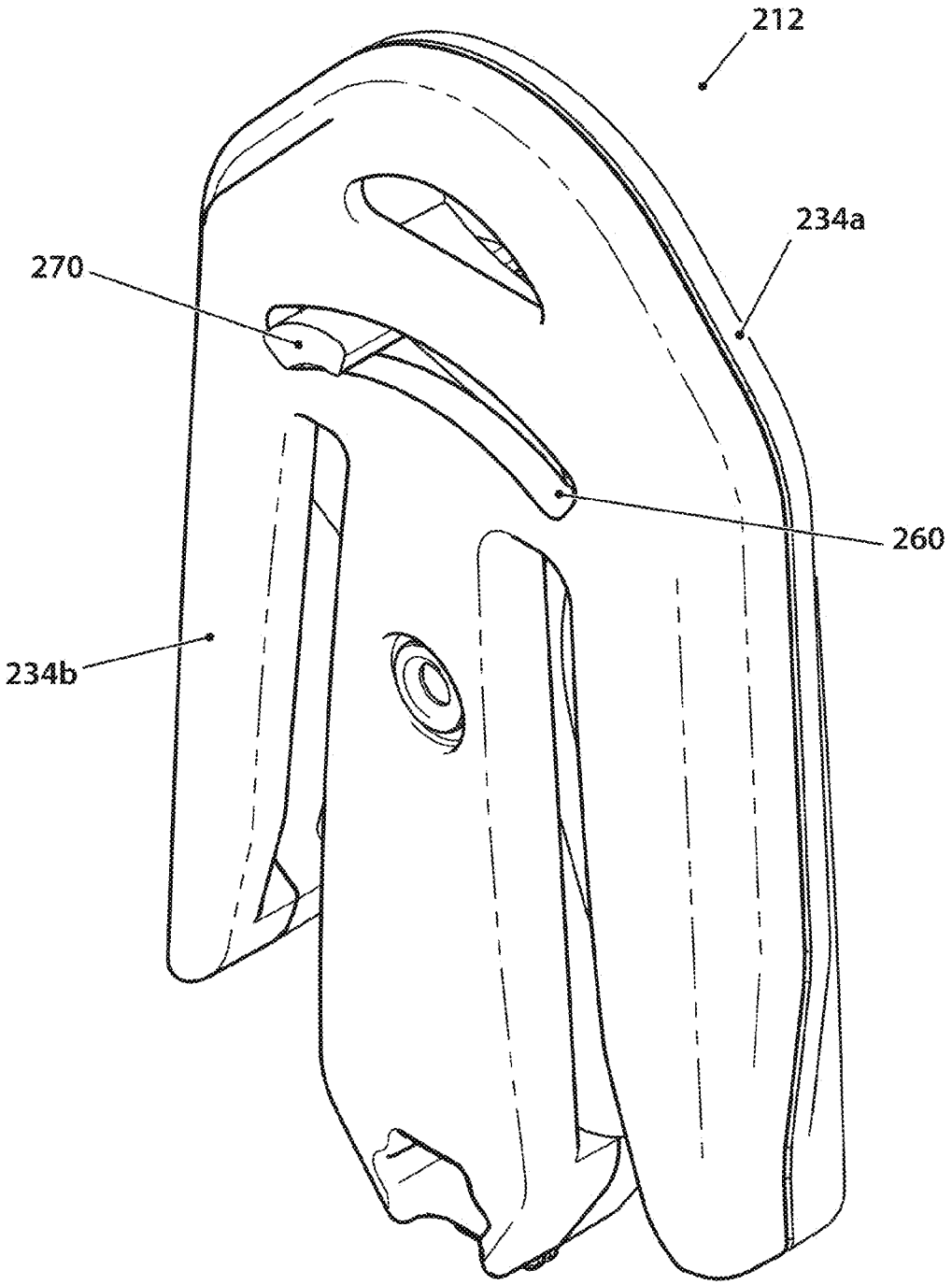
FIG. 12 is a perspective view of a tool mounting according to a third implementation of the invention.
Figure 14:
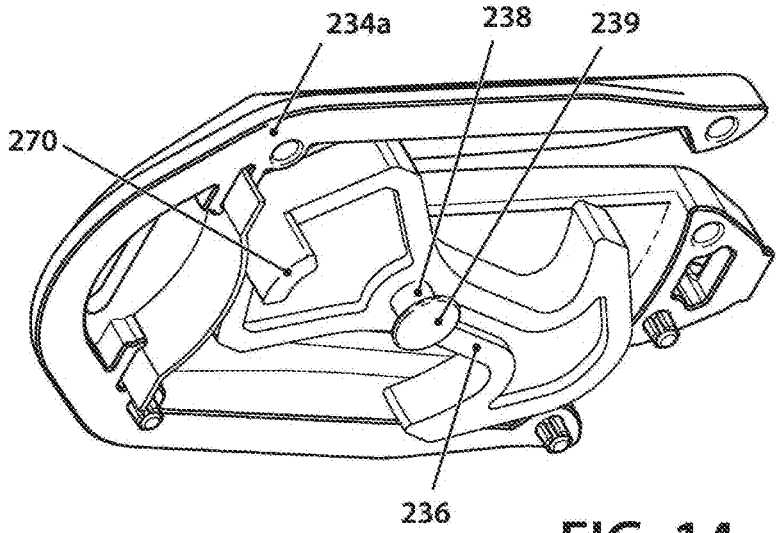
FIG. 14 is a sectioned perspective view of the tool mounting of FIG. 12.
Figure 13:
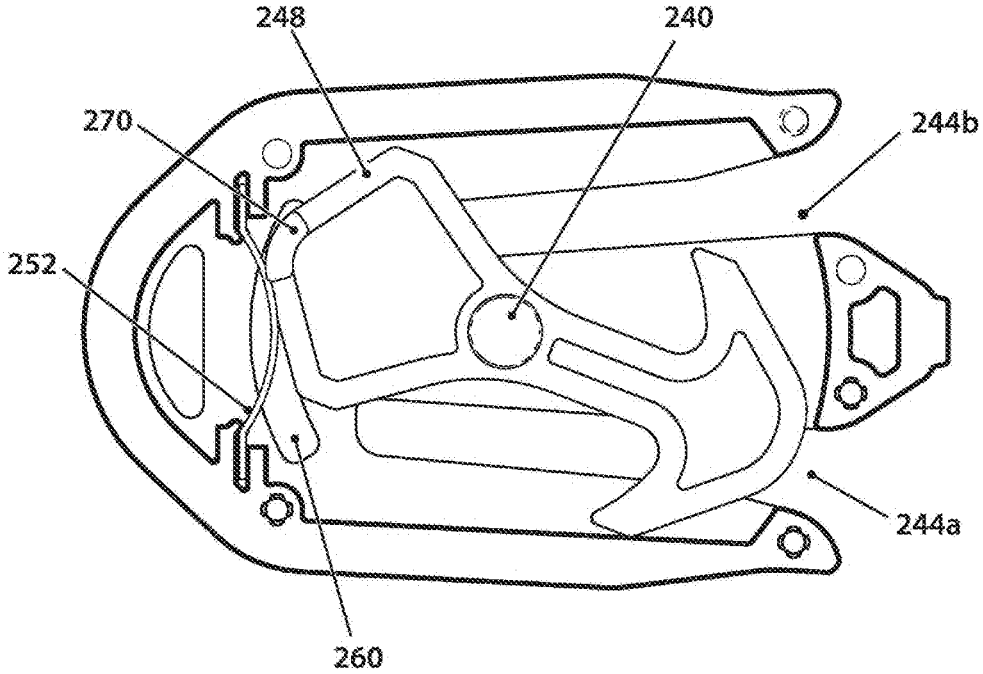
FIG. 13 is a sectioned side view of the tool mounting of FIG. 12.

FIGS. 12 to 14 show a tool mounting 212 similar to the tool mountings 12 and 112. The tool mounting 212 operates substantially identically to tool mountings 12 and 112 and has latch 236 pivoting about axle 238 to alternatively cover the end of slots 244*a* and 244*h*. The axle 238 may be formed as part of one of the housing parts 234*a* and 234*b* and the latch 236 may be a press fit onto the axle. Alternatively the axle may be a pin 239 that is heat staked or otherwise secured to one of the housing parts 234*a* and 234*b*. The pin 239 may have a head 240 to retain the latch 236 on the pin. The latch 236 is biased to be over one of the slots 244*a* and 244*h* by spring member 252. The spring member 252 is a separate component but may be formed integrally formed with housing part 234*a*.

The housing parts 234*a*, 234*b* are provided with an arc shaped slot 260 that exposes part of the tail 248 of the latch 236. The slot 260 is centred on the axle 238. The end of the tail 248 has manual release tabs 270 that extend into each slot 260. In either locked position the release tabs 270 are located toward an end of the slot 260. The housing need not have two slots 260 and may be made with only one slot 260.

The release tabs 270 extend out of the slots 260 and a user may engage one or both of the tabs 270 and rotate the latch against the biasing force of spring so that the head moves from covering the end of one slot to covering the end of the other slot. If desired the tabs may end flush with the housing parts 234*a* and 234*b*, so as to reduce the possibility of being caught on another object and accidentally releasing. If desired the tabs 270 may be recessed from the outer surface of the housing parts 234*a* and 234*b*. If desired, the slot may be sized so tabs 270 are not at the end of the slots when the latch is fully rotated. Thus a space may be provided between the end of the slot and the tab to aid engagement by a user's fingers.

Figure 15:
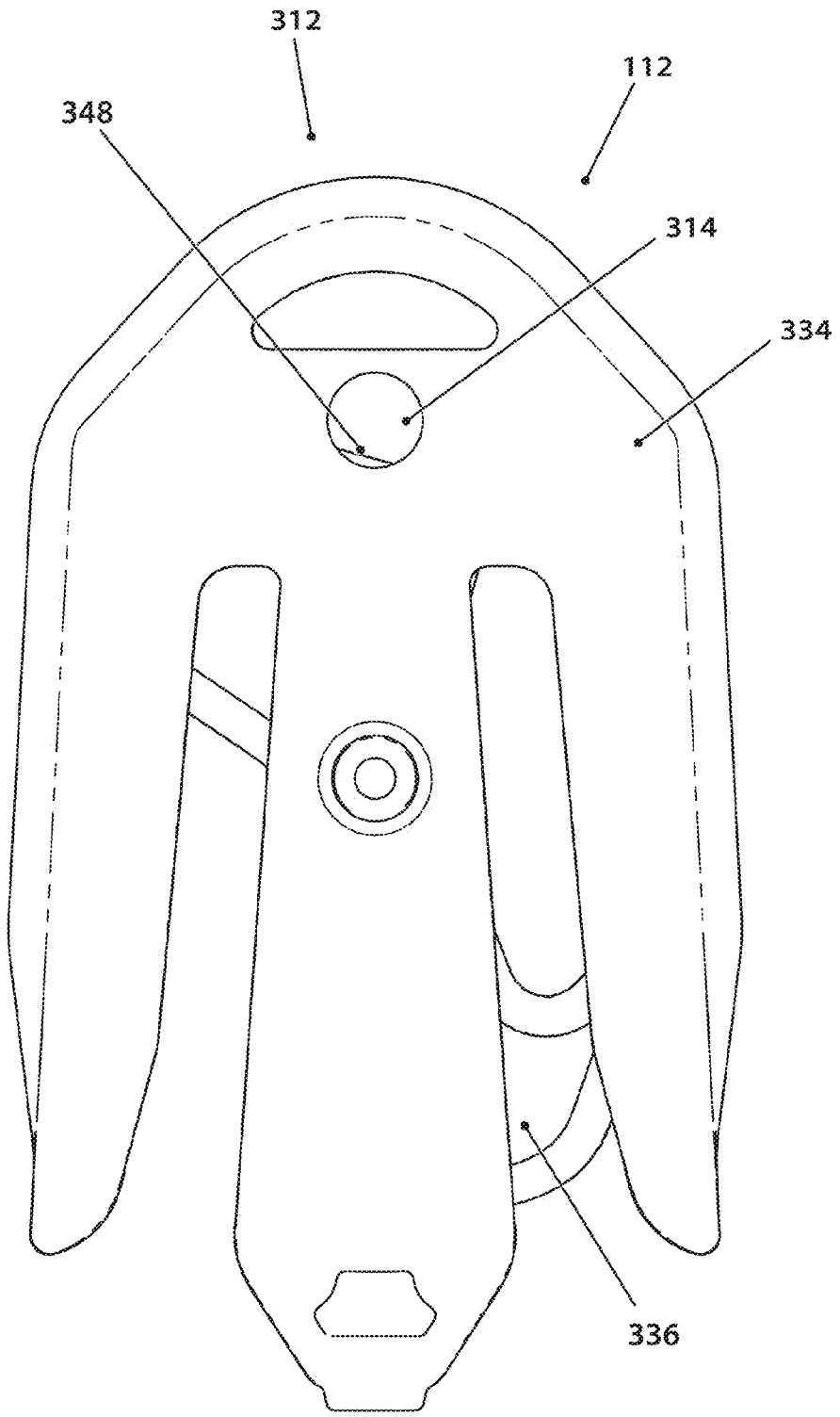
FIG. 15 is a side view of a tool mounting according to a fourth implementation of the invention.
Figure 17:
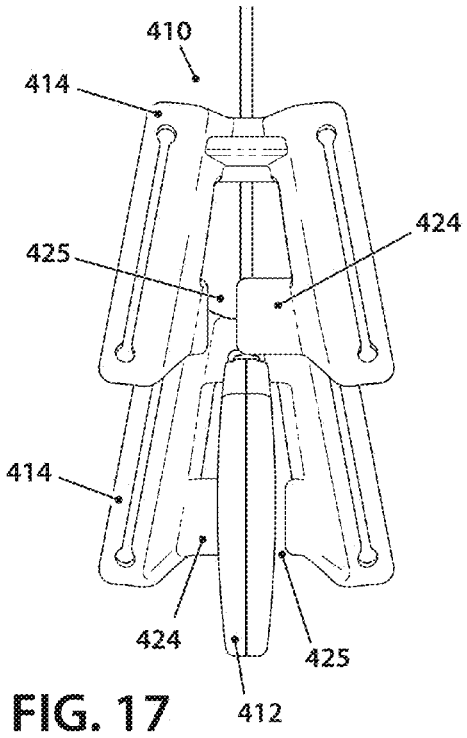
FIG. 17 is a plan view of the system of FIG. 16.
Figure 18:
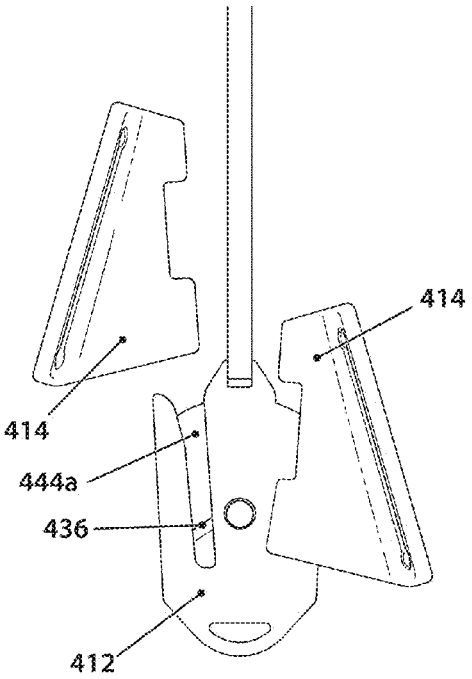
FIG. 18 is a side view of the system of FIG. 16.
Figure 16:
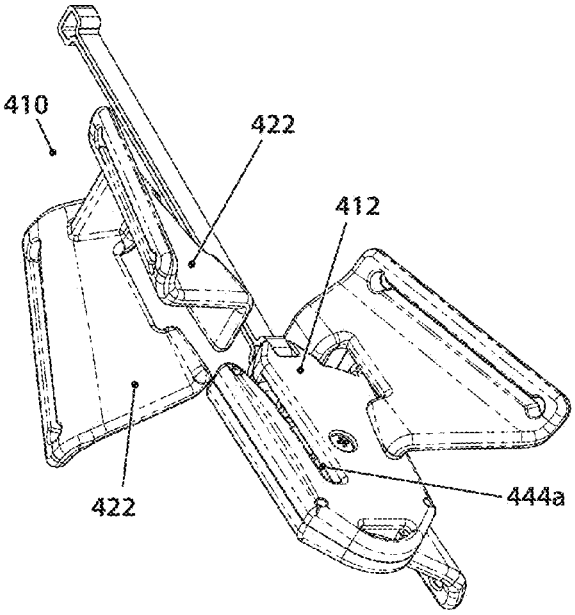
FIG. 16 is a perspective view of an attachment system according to a fifth implementation of the invention.

FIG. 15 shows a mounting 312 that is substantially the same as mounting 12 but the housing 334 is provided with a centrally located locking aperture 314 adjacent tail 348 of latch 336. The locking aperture 314 is positioned so that as the latch 336 moves from one locking position to the other at least part of the tail passes "through" the locking aperture. Preferably the locking aperture is fully closed by the tail but partial closure can be sufficient. When the latch 336 is in either locking position the tail 348 lies to one side of central hole 314. The shackle of a padlock or similar may be passed through hole 314 to lock latch in one position.

FIGS. 16 to 19 show a tool attachment system 410 that is similar to that of system 10 and the operation of the system is substantially as previously described.

The main difference is that each of slots 444*a* and 444*h* in the housing 412 do not extend on both sides of latch member 436 but are only provided in one side of the housing 412. In the version shown the slots 444*a* and 444*h* are one either side of the housing and the housing is substantially symmetrical. However the slots 444*a* and 444*h* may be provided on the same side with the other side of the housing 412 a blank face.

Since the slots 444*a* and 444*h* do not extend fully through the housing 412, the retainers 414 cannot have a rib that extends fully between side plates 422.

Figure 19:
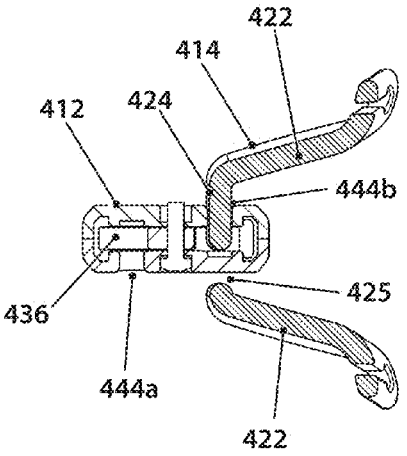
FIG. 19 is a sectioned end view of the system of FIG. 16.

Instead rib 424 extends from one side plate 422 part way toward the other, leaving a gap 425 that receives the housing 412, as best seen in FIG. 19. This provides the ability for the mounting 412 to only be picked up by a left or right sided retainers. This also has more security as the latch cannot be tripped by accidentally inserting a flat bar, rope or wire into the open slot—to remove it the retainer must key into the slot. This version also provides for a user to manually release the retainer from the mounting by sliding the end of a rod or screwdriver along the open slot.

Figure 21:
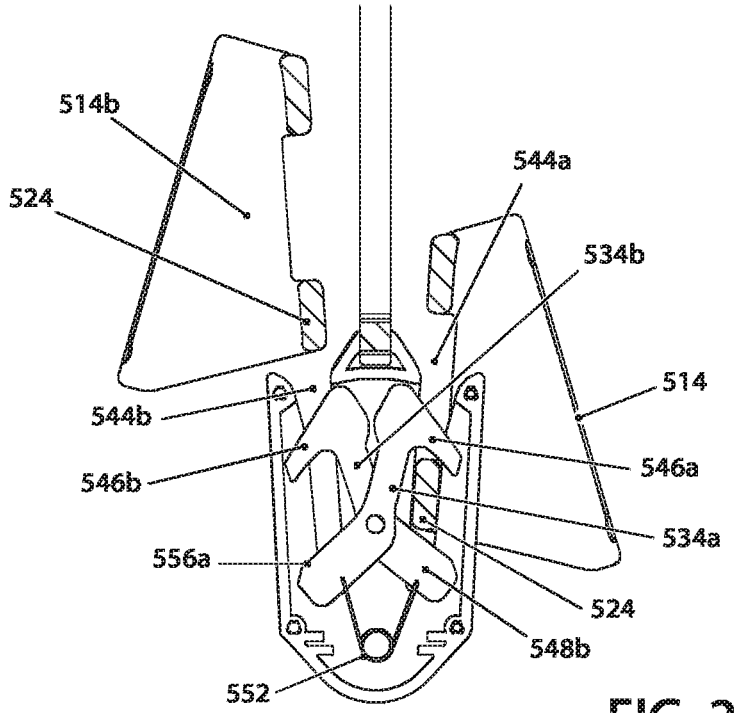
FIG. 21 is a sectioned side view of an attachment system according to a sixth implementation of the invention.
Figure 20:
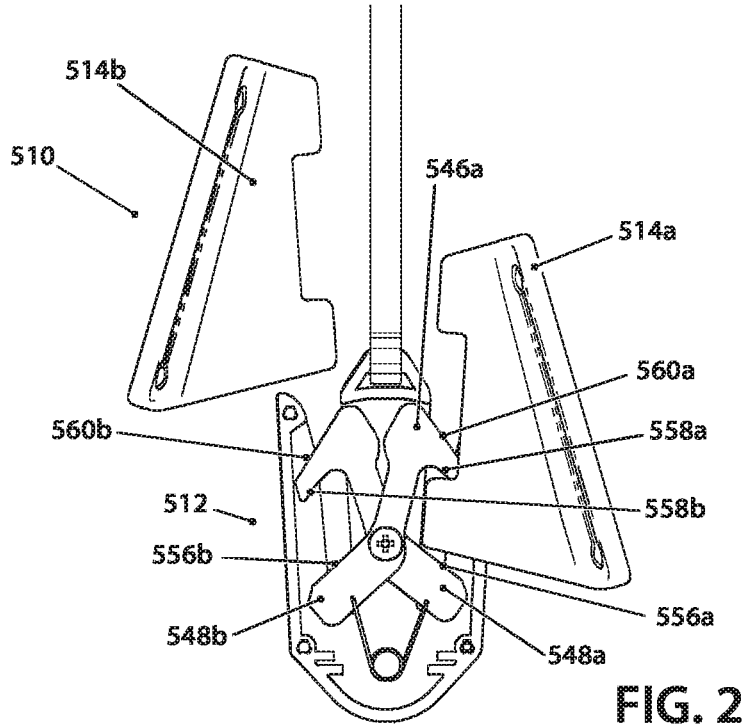
FIG. 20 is a side view of an attachment system according to a sixth implementation of the invention with a part of a housing not shown.
Figure 22:
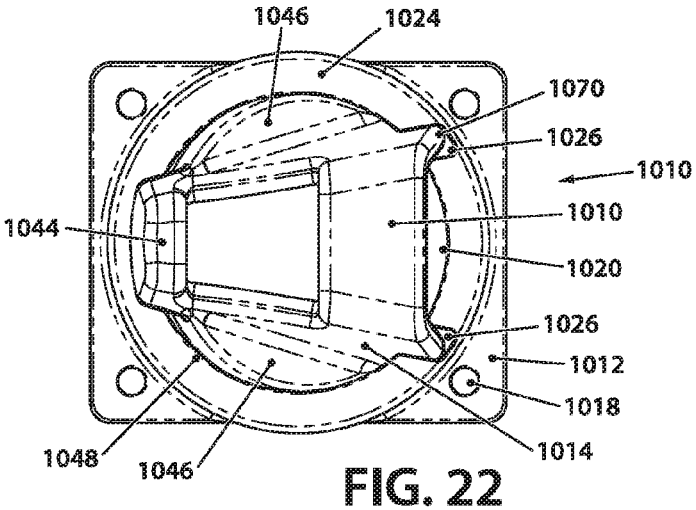
FIG. 22 is a plan view from above of a rotating retainer or dock according to the invention.
Figure 23:
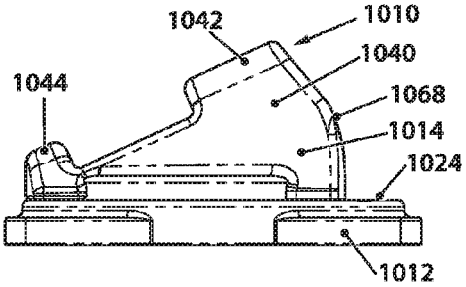
FIG. 23 is a side view of the rotating dock of FIG. 22.
Figure 24:
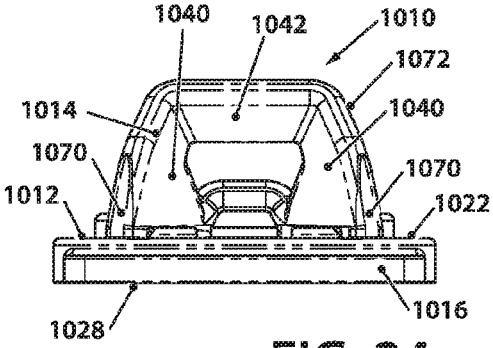
FIG. 24 is a rear end view of the rotating dock of FIG. 22.

FIGS. 20 to 21 show a tool attachment system 510. The system utilises retainers 514 substantially the same as retainers 14 and a twin slot mounting 512 similar to the previously described mounting. However, the latch mechanism is not a single member but includes two latch members 534*a*, 534*b* mounted for rotation about common axle 538, one above the other. The two latch members 534*a*, 534*b* are substantially mirror images of each other. Latch member 534*a* has head 546*a* and tails 548*b*, whilst latch member 534*b* has head 546*b* and tail 548*a*. Each head 546*a* and 546*b* has angled surfaces 558*a*, 558*b* and 560*a*, 560*b*, respectively whilst each tail 548*a* and 548*b* has angled surfaces 556*a*, 556*b*, respectively. The head 546*a* of latch member 534*a* thus comprises a first latch portion and the tail 548*b* a second release portion with angled surface 556*b* comprising a second engagement surface. Similarly, the head 546b of latch member 534*b* comprises a second latch portion and the tail 548*a* a first release portion with angled surface 556*a* comprising a first engagement surface. A rib 524 of a retainer 514 is trapped in slot 544*a* by the head 546*a* in a similar manner to the other embodiments.

A torsion spring 552 is connected to the two latch members 534 at their tails. The spring 552 is biased to separate the two tails and this causes the heads to the biased outwards.

In use, when a second retainer 514*b* is inserted into slot 544*b*, the rib 524*b* engages head 546*b* and urges it inwards toward the centreline of the device. This causes the tail to move inwards and, via spring 552, urge the head 564*a* of the other latch member outwards, maintaining the retaining function of that retaining member. Once the rib 524*b* has passed the head 564*b*, the head 564*b* springs outwards to prevent removal of the rib 542*b* from slot 546*b*. Continues motion causes the rib 524*b* to engage on engagement surface 556*a* of latch member 534*a* and causes anticlockwise rotation, drawing head 546*a* inwards and clearing the opening of slot 544*a* and allowing retainer 514*a* to be removed from the mounting 512.

Referring to FIGS. 22 to 29 there is shown another retainer or dock 1010 for use with the attachment device as previously described.

The dock 1010 comprises a mounting member 1012 and a retainer 1014 mounted on the mounting member 1012 for rotation about an axis.

The mounting member 1012 has a base 1016 with a number of mounting apertures 1018 therein. In this embodiment the base 1016 is generally rectangular shaped and there are four apertures 1018, one at each corner. The apertures 1018 are to enable a fastener, such as a rivet, to secure the dock 1010 to another object, such as a structure. The shape of the base 1016 and number of apertures 1018 is not critical.

The base 1016 has a mating portion that mates or engages with the retainer.

The mating portion includes or has circular aperture 1020 therein, upper annular surface 1024 surrounding the aperture 1020 and lower annular surface 1030 surrounding the aperture 1020. The annular surface 1024 is generally smooth and lies in a plane. Two spaced apart slots 1026 extend into the annular surface 1024. The slots extend though the mating portion from the upper surface 1024 to the lower surface 1030. The annular surface 1030 has a series of recesses 1032 that are arranged circumferentially around the aperture 1020.

The retainer 1014 has spaced apart side walls 1040 joined by cross walls 1042 and 1044. The retainer 1014 is functionally the same as retainer 14 shown in FIGS. 1 to 4 with cross wall 1044 being functionally equivalent to wall 24 and cross wall 1042 functionally equivalent to wall 32.

Figure 25:
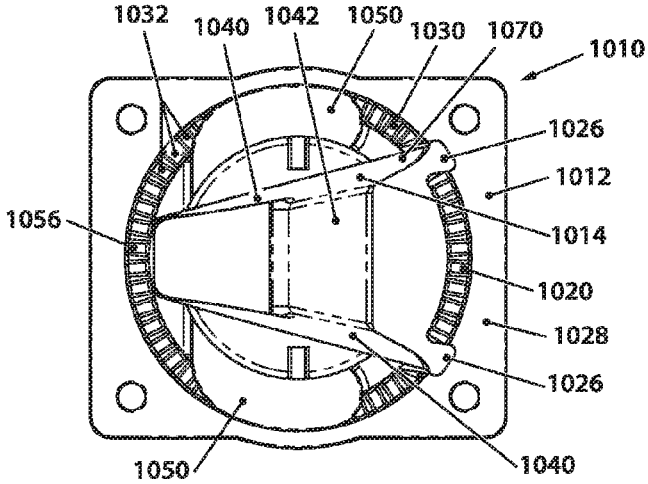
FIG. 25 is a plan view from below of the rotating dock of FIG. 22.
Figure 27:
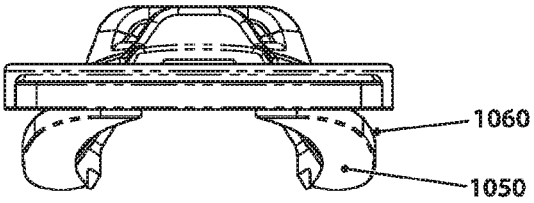
FIG. 27 is a rear end view of the rotating dock of FIG. 22 partially assembled.
Figure 26:
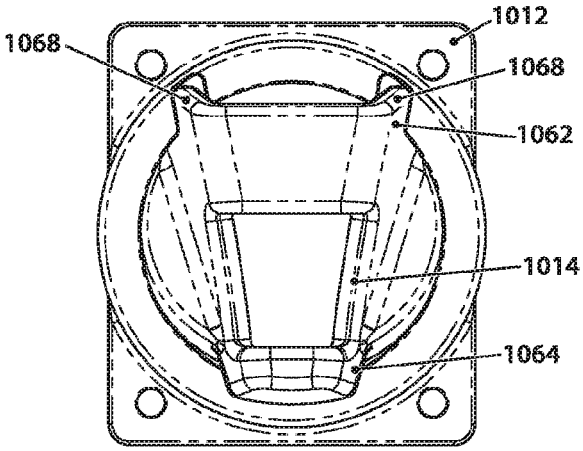
FIG. 26 is a plan view from above of the rotating dock of FIG. 22 partially assembled.
Figure 29:
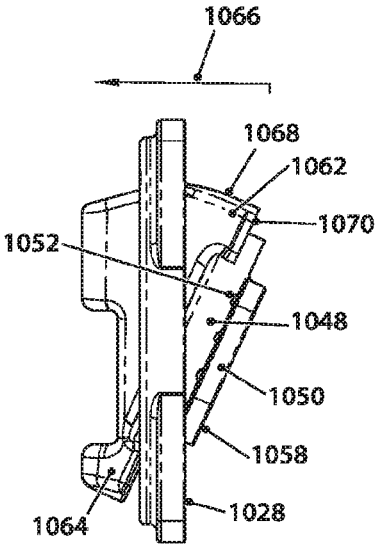
FIG. 29 is a side view of the rotating dock of FIG. 22.
Figure 28:
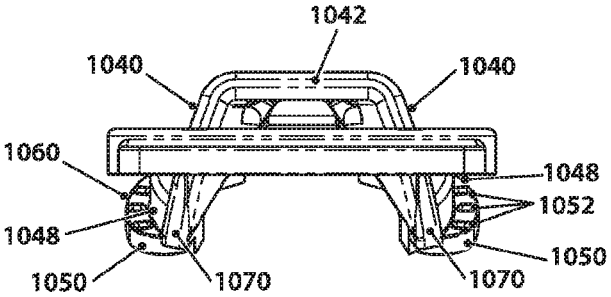
FIG. 28 is a front end view of the rotating dock of FIG. 22 partially assembled.
Figure 32:
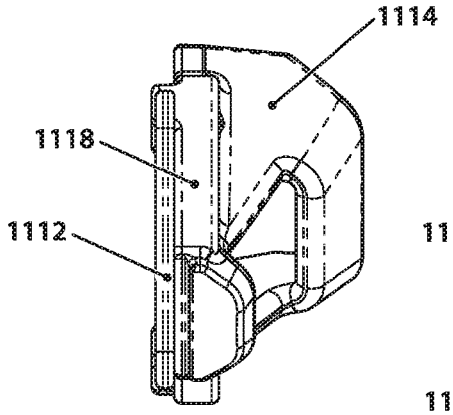
FIG. 32 is a right side view of the rotating dock of FIG. 30.

Extending from each side wall 1040 is guide portion 1046. The guide portions 1046 have a part circular edge 1048 that has a radius the same or a slightly smaller than the radius of the aperture 1020 so the retainer may fit snuggly in the aperture 1020 and allows the retainer 1012 to rotate relative to the mounting member 1012. Each guide portion 1046 has a lower securing portion 1050 that extends beyond the edge of the aperture and, as seen in FIG. 25 extends under annular surface 1030. Each securing portion 1050 has at least one and preferably more than one, protrusion 1052 that is sized and located to engage in recesses 1032 in annular surface 1030. The protrusions 1052 and 1032 thus form a detent mechanism that controls the relative rotation of the two components. Accordingly the securing portions 1050 also act as detent portions.

The annular surface 1030 is preferably recessed relative to the base surface 1028 of mounting member 1012 and so a short cylindrical wall 1056 extends from the base surface 1028 to the annular surface 1030. The thickness of the securing portion 1050 is such that their lower surface 1058 is recessed relative to the base surface 1028, but they may be flush. Preferably the securing portions 1050 have a part circular edge 1060 that has a radius the same or a slightly smaller than the radius of the wall 1056. The circular edges 1048 and 1060 thus serve to centre the retainer within the aperture 1020.

The retainer has end portions 1062 and 1064 that extends over the upper annular surface 1024. These end portions 1062 and 1064 act as upper securing portions and act to secure the two components together, with the base plate 1016 sandwiched between these upper and lower securing portions 1062, 1064 and 1050 respectively. The spacing between end portions 1062 and 1064 and the securing portions 1050 is chosen to hold the securing portions 1050 relatively firmly against the lower annular surface 1030 with protrusions 1052 in recesses 1032. The retainer 1014 may be rotated relative to the mounting member 1012, with the securing portions 1050 flexing slightly to allow protrusions 1052 to ride out of recesses 1032.

The slots 1026 allow the retainer and mounting to be assembled but remain connected during use. As seen in FIGS. 26 to 29, to assemble the dock 1010 the retainer 1014 is placed below the lower surface 1028 of the mounting member and aligned so that side walls 1040 are generally aligned with the slots 1026. End portion 1064 is inserted through the aperture 1030 at an angle until it overlies a part of upper annular surface 1024, with the forward parts of guide members 1046 against the forward end of the aperture 1030. The retainer 1014 is then pivoted upwards about that forward location, as indicated by arrow 1066. The side walls 1040 extend beyond the edge of the aperture 1030 and so can only pass from below to above the mounting member 1012 by their ends 1068 passing through slots 1026. The ends 1068 of the side walls 1040 are angled with the lower edges 1070 having a greater separation than upper portions 1072. The ends 1068 are also shaped to allow the upper portions 1072 to fit within the aperture 1030 as the retainer is rotated. As the retainer is rotated the ends 1068 engage in the slots 1026 and cause the two ends 1068 to move toward each other as the retainer is rotated upwards. Once the lower edges 1070 pass through the slots 1026, the walls 1040 spring outwards so as to overly the annular surface. Once assembled the lower edges 1070 have a greater separation than the slots 1026, as seen in FIG. 25 and so when one side wall is aligned with one of the slots the other side wall is not aligned with the other slot. Thus the dock 1014 cannot easily become disengaged from the mounting member. However, if disassembly is required, compressing the side walls 1046 together allows the slots 1026 and lower edges 1070 to be aligned and the dock may be rotated downwards.

Once assembled the mounting member may be secured to a suitable object and the retainer rotated relative to the mounting member and the object to which it is secured.

FIGS. 30 to 34 show a further variation of a rotatable retainer assembly 1110

The assembly 1110 comprises a base plate 1112 and a retainer 1114. The retainer has guide members 1116 with downwardly extending arcuate walls 1118 that define a cylindrical recess 1120. The base plate 1112 has a disk like mating portion 1122 sized to fit in the recess 1120, whereby the retainer 1114 may rotate relative to the base plate 1112.

The arcuate walls 1118 each include a downward extending tab 1124 that includes securing portion 1126 that, when assembled, extends inwardly underneath the lower surface 1128 of disk like mating portion 1120. The lower surface 1128 includes two arcuate portions 1130 that have a series of recesses 1132. The upper surface of the securing portions 1126 have at least one protrusion 1134 that engages in one or more of the recess 1130 so as to hold the retainer and mounting member is a fixed position until rotated by a user.

The disk like mating portion 1122 includes two cut outs or slots 1136 that allow the retainer and mounting member to be assembled, by pushing the two components together with the securing portions 1126 aligned with the slots 1136. When assembled the securing portions 1126 extend radially inwards more than the slots 1136 even when aligned with the slots 1136. This requires the tabs 1124 to flex outwards during assembly to allow the securing portions 1126 clear the disk like mating portion 1120 with the tabs 1124 snapping inwards when the securing portions 1126 have cleared the disk portion 1120.

In the embodiment shown the mounting member includes three mounting locations 1140, each with an aperture 1142 to allow a fastener, such as a rivet, to pass through and secure the mounting member to an object.

Figure 30:
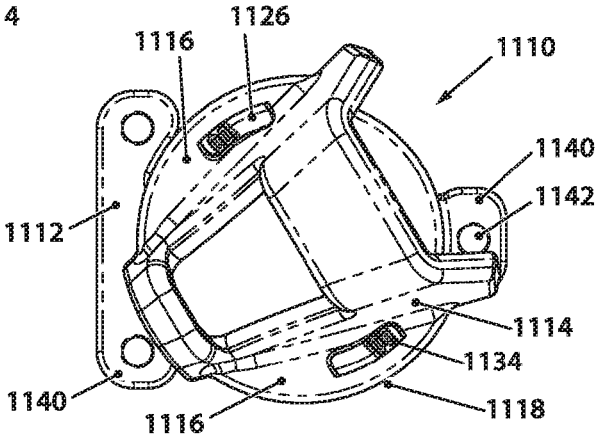
FIG. 30 is a plan view from above of another rotating retainer or dock according to the invention.
Figure 31:
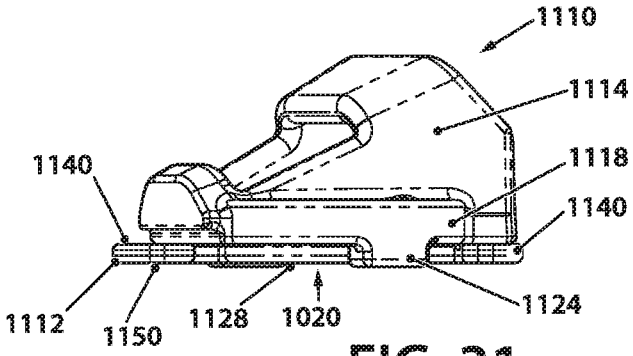
FIG. 31 is a left side view of the rotating dock of FIG. 30.
Figure 33:
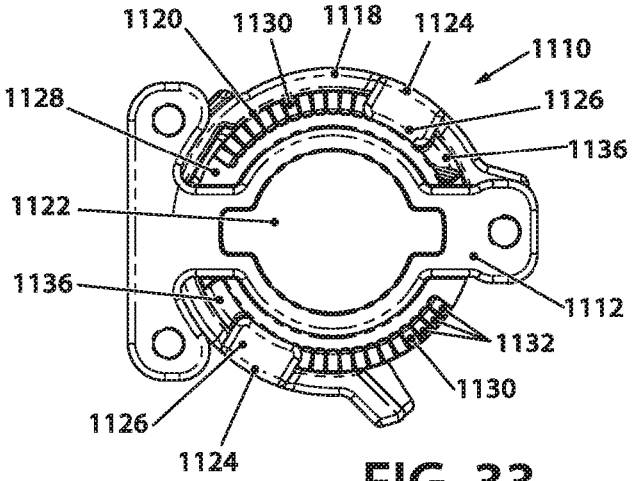
FIG. 33 is a plan view from below of the rotating dock of FIG. 30.
Figure 30A:
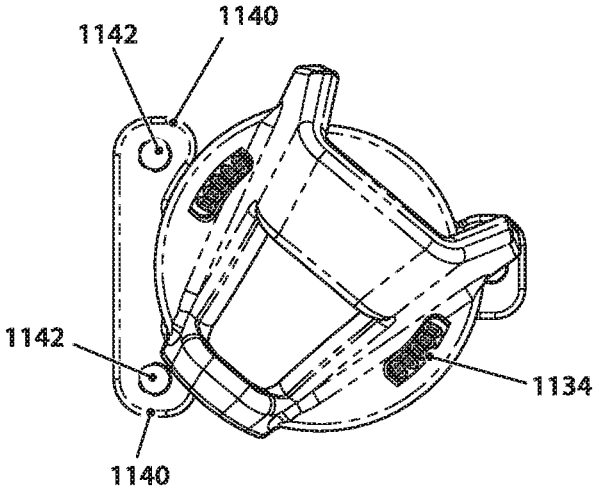
FIG. 30*a* is a plan view of the rotating dock of FIG. 30 in another orientation.
Figure 30B:
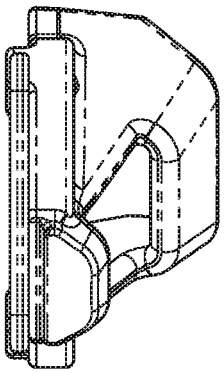
FIG. 30*b* is a right side view of the rotating dock of FIG. 30*a*.
Figure 34:
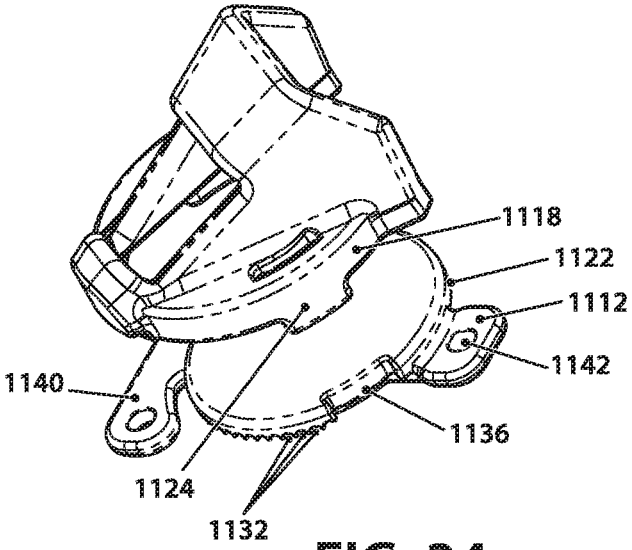
FIG. 34 is an exploded perspective view from above of the rotating dock of FIG. 30.
Figure 35:
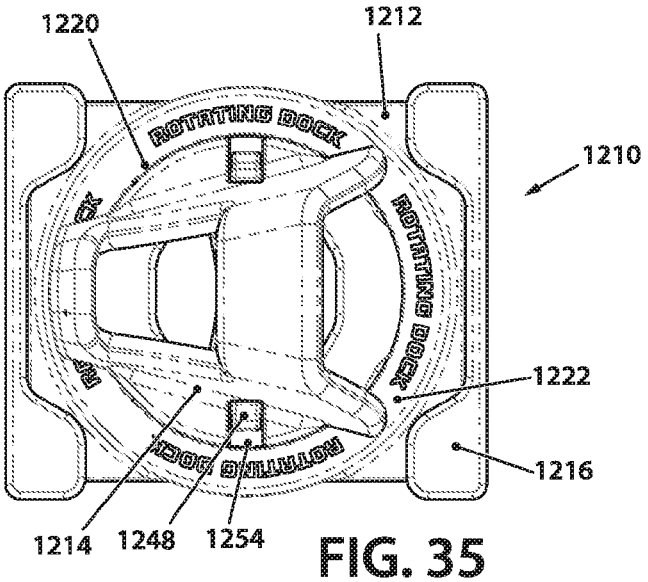
FIG. 35 is a plan view from above of a further rotating retainer or dock according to the invention.

As best seen in FIGS. 30 and 31 these mounting locations 1140 extend from the disc like mating portion 1122 but extend into the swept volume of the securing portions 1126 and tabs 1124, so preventing full rotation of the retainer 1114 relative to the mounting block 1112. If desired, the mounting locations 1140 may connect to the circular disc so as not to extend into the swept volume of the extensions 1126 and tabs 1124. This may be by connecting to the circular disc portion 1122 radially inwards and also axially below the swept volume.

The lowermost portion of the dock is preferably the lower surface 1150 of the mounting member, so that when mounted flush on the surface of an object the retainer portion 1114 is free to rotate without contact with the object's surface. As an alternative, the lowermost portion may be the securing portions 1126, as shown in the figures, in which case use of spacers, such as washers, may be desirable. However, when mounted on flexible webbing or a belt the slight resistance to movement may be desirable.

FIGS. 35 to 43 show another retainer assembly 1210 for use with the retention device. The retainer assembly 1210 is intended for mounting on a work belt of the like. The retainer assembly 1210 comprises base 1212, retainer 1214 and belt mounting 1216. The belt mounting 1216 may be used with the retainer assembly 1010.

The base 1212 and retainer 1214 are similar to base 1012 and 1014 and when assembled function substantially the same. Accordingly, base 1212 has mating portion with aperture 1220, upper annular surface 1222 and recessed lower annular surface 1224 with recesses 1226. Retainer 1214 has side walls 1230 with cross walls 1232 and 1234, guide portions 1236 and securing portions 1238 with protrusions 1240 that engages in recesses 1226 to from a detent.

Figure 43:
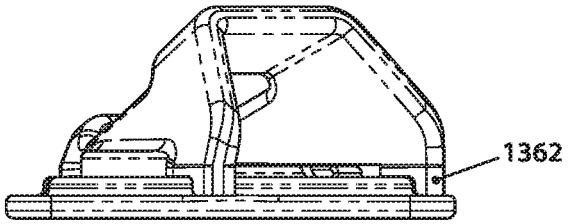
FIG. 43 is a side view of the rotating dock of FIG. 44.
Figure 45:
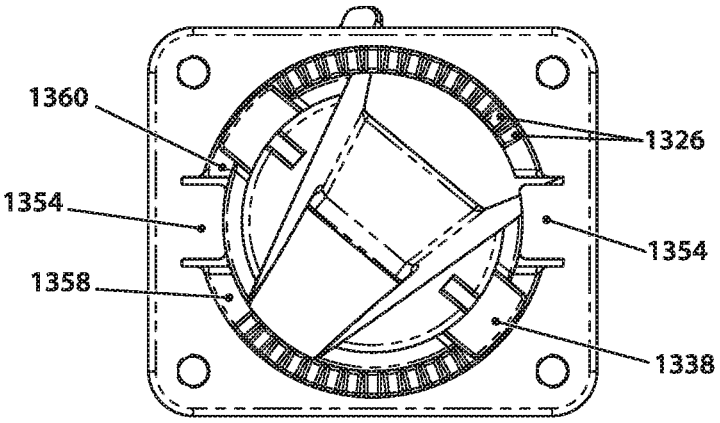
FIG. 45 is a plan view from below of the rotating dock of FIG. 35.
Figure 46:
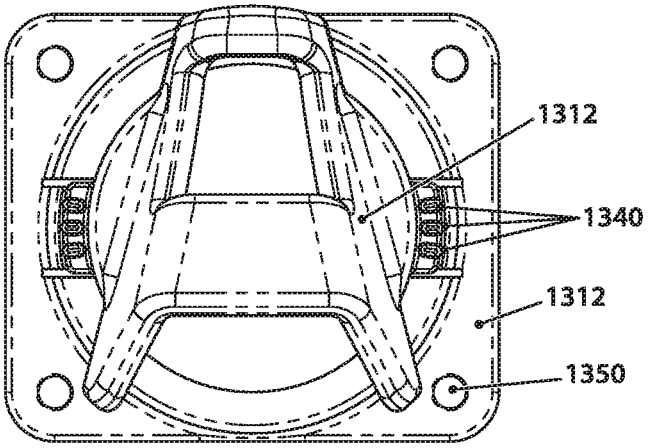
FIG. 46 is a plan view from above of the rotating dock of FIG. 22 partially assembled.
Figure 47:
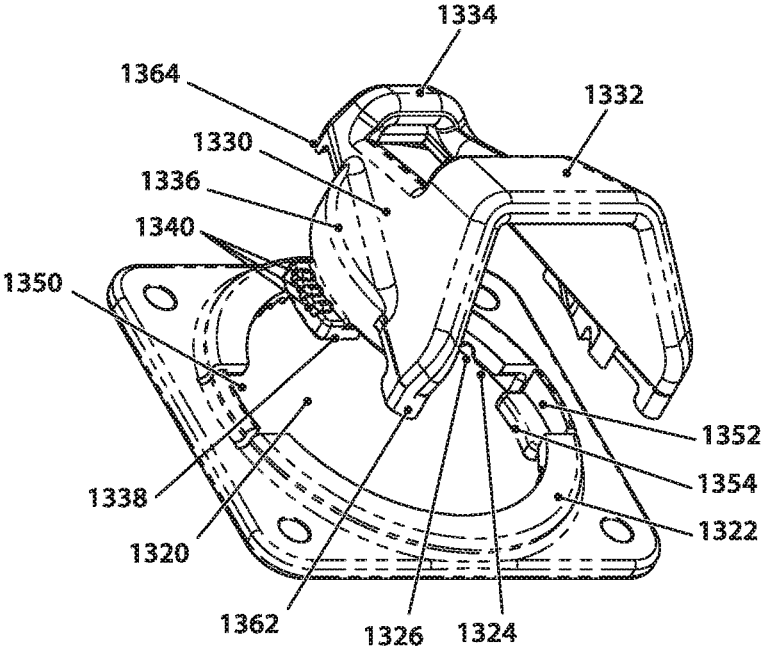
FIG. 47 is an exploded perspective view from above of the rotating dock of FIG. 35.

The base 1212 differs from base 1012 in that it does not have slots corresponding to slots 1026. The retainer 1214 is formed to be flexible so as to allow the side walls 1230 to be squeezed together relatively easily. This allows the retainer to be inserted into the aperture 1220 from above. A first one of the securing portions 1238 of a first side wall is passed through the aperture 1220 from above so a part lies in the recess in the base. A compressive force is applied to the other side wall 1030 to urge it toward the first side wall, until the other securing portion 1238 clears the aperture 1220. The retainer is then rotated to pass the other securing portion 1238 through the aperture 1222 and the compressive force removed, so allowing the other securing portion 1238 to move under the base. As with the retainer of FIGS. 22 to 29, the ends 1232 and 1234 extend over the upper annular surface 1222 and secure the retainer in the base. After assembly of the retainer and base together a clip member 1240 may optionally be secured to the retainer 1214 from below to prevent accidental disassembly. The clip member 1240 comprises an elongate member 1244 with retention clips 1246 at each end. Each Clip 1246 has an angled upper surface 1248 and flat lower surfaces 1250. The retainer has two opposed slots 1252 to receive the clips 1246 of the clip member. The clip member 1242 is inserted into the underside of the retainer 1214 until clips 1246 pass though slots 1252 and spring out over surfaces 1254. As seen in FIG. 43 the clip member fits snugly against the tabs and so prevents the tabs being compressed inwards.

The assembled retainer and base may be mounted on an object using mounting apertures 1250 or, optionally, mounted on or in belt mounting 1216.

Belt mounting 1216 has two opposed side walls 1260 spaced to receive the base 1212. The ends of the side walls have tabs 1262 extending inwards and each tab has a downward extending protrusion 1264 that is received in mounting aperture 1266 of mounting member 1212. Side walls 1260 are joined by cross member 1268 that extends from the lower edge or lower region of side walls 1260. There may be more than one cross member 1268.

Figure 36:
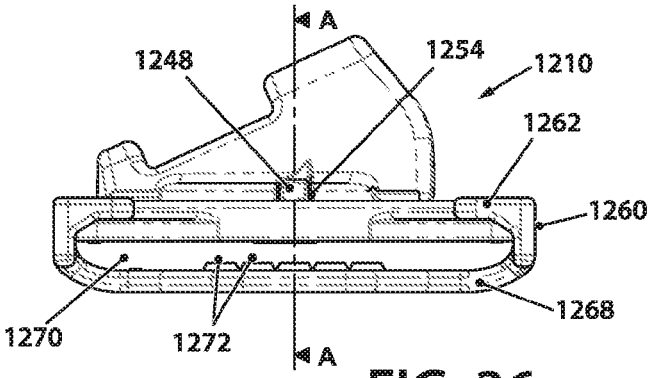
FIG. 36 is a left side view of the rotating dock of FIG. 35.
Figure 37:
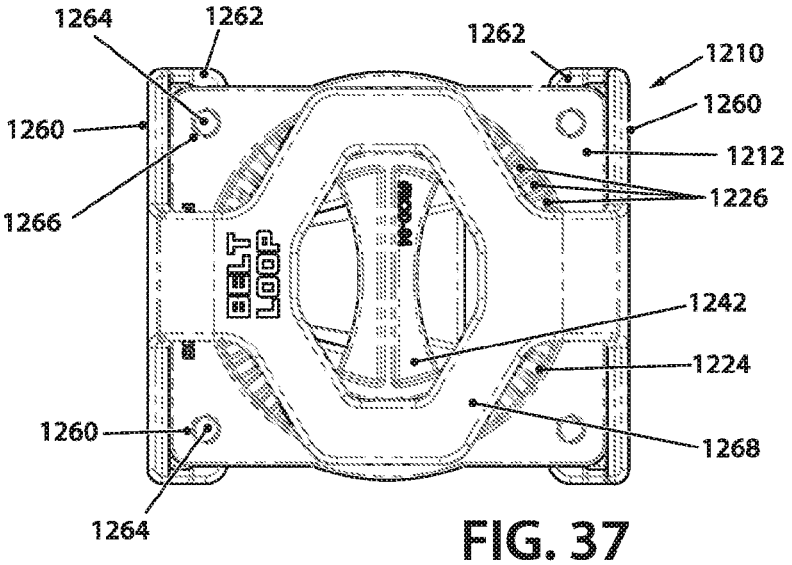
FIG. 37 is a plan view from below of the rotating dock of FIG. 35.
Figure 38:
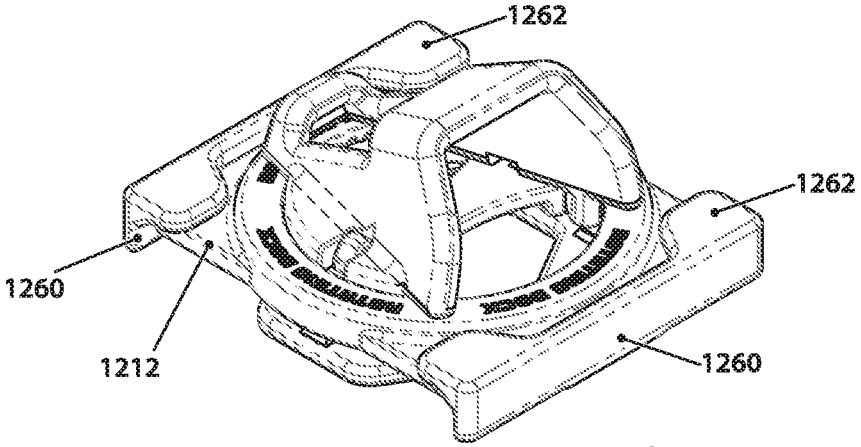
FIG. 38 is a perspective view from above of the rotating dock of FIG. 35.
Figure 39:
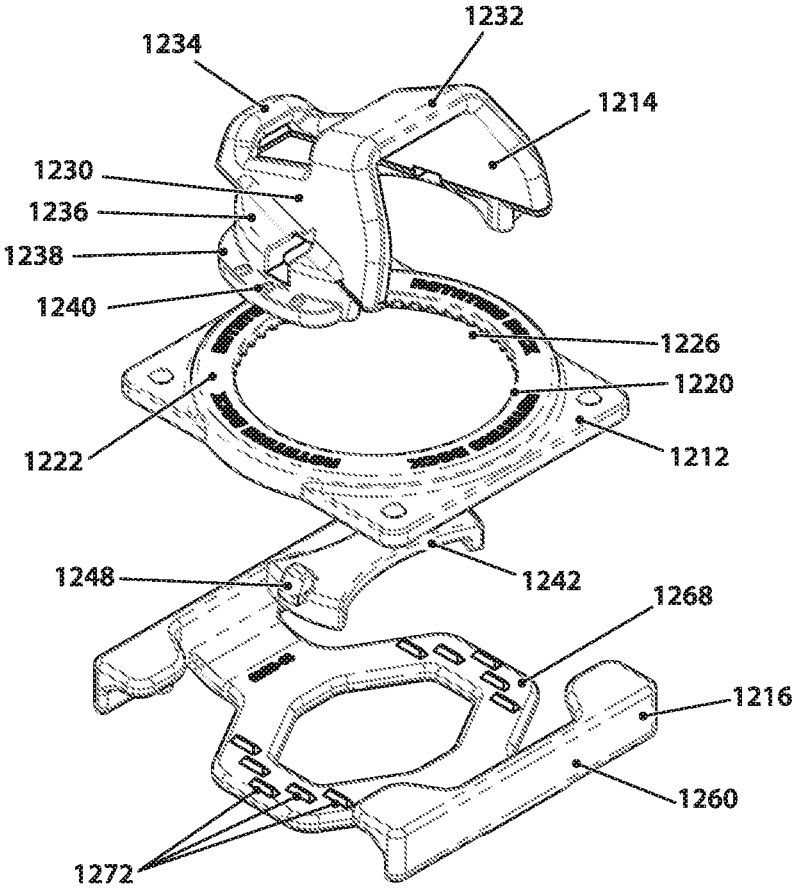
FIG. 39 is an exploded perspective view from above of the rotating dock of FIG. 35.
Figure 40:
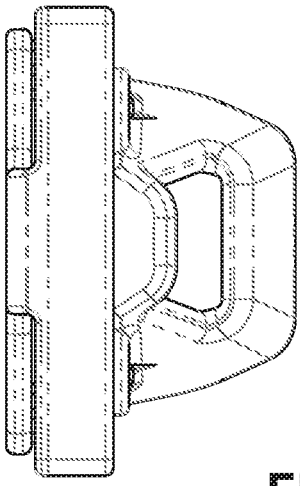
FIG. 40 is a front end view of the rotating dock of FIG. 35.
Figure 41:
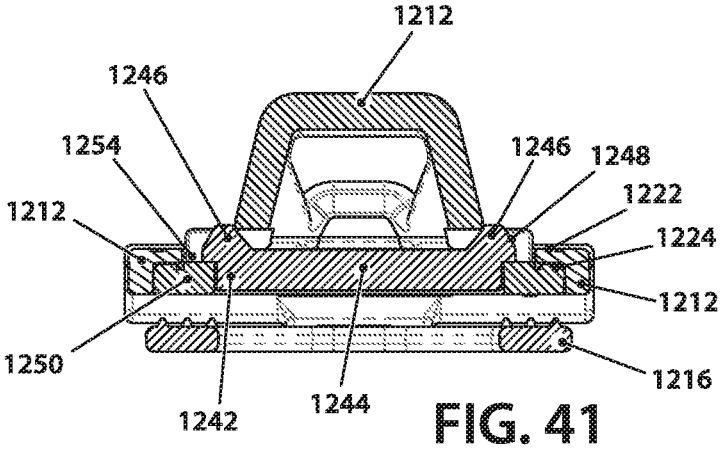
FIG. 41 is a cross sectional view of the rotating dock of FIG. 35 taken along line AA in FIG. 36.
Figure 44:
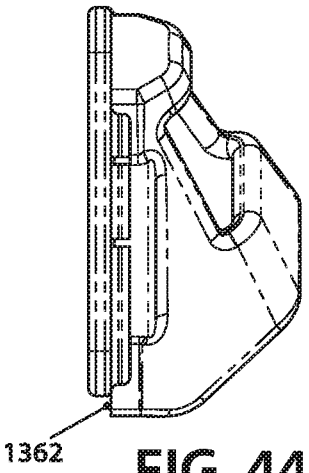
FIG. 44 is a front side view of the rotating dock of FIG. 44.
Figure 42:
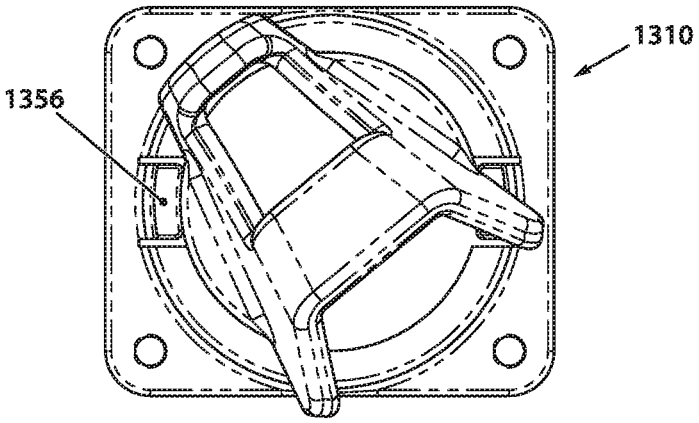
FIG. 42 is a plan view from above of a further rotating retainer or dock according to the invention.

As seen in FIG. 36, when the mounting member is mounted in belt mounting 1216 there is passageway 1270 between the mounting 1212 and the cross member 1268 though which a belt may be passed. The belt mounting is not intended to be permanently affixed to the belt but is intended to be able to be easily placed at an arbitrary position along a belt but once positioned remain relatively secure on the belt and not move along the belt. Accordingly, the cross member 1268 has a series of protrusions 1268 that extend toward the mounting 1212. The thickness of the belt with which the assembly is used is preferably greater than the separation of the protrusions 1272 from the bottom of the mounting member 1212, so the cross member 1268 is slightly flexed to cause the protrusions 1272 to engage the belt more than otherwise.

When mounted on a belt the belt prevents the mounting member 1212 moving away from the upper tabs 1262 and disengaging itself from the belt mounting 1216.

If desired the belt mounting may be permanently secured to a belt by stitching, riveting or the like. Suitable apertures may be provided to enable stitching, riveting or the like of the belt mounting to the belt.

FIGS. 44 to 48 show another retainer assembly 1310 for use with the retention device. The retainer assembly 1310 comprises base 1212, retainer 1214.

The base 1312 and retainer 1314 are similar to bases 1012, 1212 and 1014, 1214 and when assembled function substantially the same. Accordingly, base 1312 has aperture 1320 with upper annular surface 1322, recessed lower annular surface 1324 with recesses 1326. Retainer 1314 has side walls 1330 with cross walls 1332 and 1334, guide portions 1336 and securing portions 1338 with protrusions 1340 that engages in recesses 1326.

The base 1312 differs from base 1012 in that it does not have slots corresponding to slots 1026 and retainer 1314 is not intended to be compressed to allow assembly.

The mounting member 1312 has two slots 1350 that are sized and spaced to receive the extensions. An L-shaped tab 1352 extends into each slot 1350 and has an inwardly extending extension 1354. When the retainer is inserted from above into the aperture 1320 the securing portions 1338 pass into the slots 1350 and initially rest on the extensions 1354, as seen in FIG. 48.

The vertical separation of the upper surface 1356 of the securing portions 1354 from the lower surface 1358 of lower annular surface 1324 is less than the thickness (excluding the protrusions 1340) of the securing portions 1338. It is thus necessary to push the retainer downwards relative to the mounting member to deflect the L shaped tabs 1352. Once deflected enough the retainer may be rotated to move the securing portions 1338 out of alignment with slots 1350. The annular surface 1324 may have angled surfaces 1360 to aid this.

Once the securing portions 1338 are fully clear of the tabs 1352 they spring back to the un-deflected state and so the retainer is secured to the mounting member.

In this embodiment the upper annular surface 1322 is raised relative to the surrounding parts of the mounting member. The retainer 1314 includes downward extensions 1362 and 1364 that extend beyond and down the sides of the raised portion of the mounting member. These downward extensions 1362 and 1364 may be omitted. Similarly it is not necessary that the mounting member 1312 has a raised portion around aperture 1320. In a similar manner, the other embodiments described may also have a raised portion around their central aperture and optionally the corresponding retainers may also have downward extensions.

The assembled retainer and base may be mounted on an object using mounting apertures 1350 or, optionally, mounted on or in belt mounting 1216.

It will be appreciated that the features of the invention described or mentioned in this document in relation to one or more implementations may be combined in any combination of features of one or more other implementations where features are not mutually exclusive.

It will be apparent to those skilled in the art that many obvious modifications and variations may be made to the embodiments described herein without departing from the spirit or scope of the invention.

I claim:

1. A retention system comprising a rotatable dock and an attachment device adapted to be connected to the rotatable dock, the dock comprising:

a retainer member comprising a retention portion adapted to be trapped by the retention system, and a mounting member adapted to be mounted on an object;

the retainer member mounted on the mounting member for rotation about an axis, and a detent mechanism that resists relative rotation of the mounting and retaining members and the attachment device including:

a first elongate slot having an open first end, the first slot adapted to receive a retention portion of the first dock via the open first end;

a second elongate slot having an open second end, the second slot adapted to receive a retention portion of a second retainer via the open second end;

a first latch portion and a second latch portion;

a first release portion having a first engagement surface, and a second release portion having a second engagement surface, wherein the first latch portion and the second release portion are connected together for rotation about a first axis;

the second latch portion and the first release portion are connected together for rotation about a second axis;

the first latch portion and second release portion are connected to the second latch portion and first release portion;

the first latch portion is rotatable about the first axis between a first retaining position and a first open position and, in the first retaining position the second engagement surface is located in the second slot at a second release position remote from the second end, and at least part of the first latch portion extends into or across the first slot to substantially block the slot, and in the open position the first slot is not blocked by the first latch portion;

the second latch portion is rotatable about the second axis between a second retaining position and a second open position, and in the second retaining position, the first engagement surface is located in the first slot at a first release position remote from the first end, and at least part of the second latch portion extends into or across the second slot to substantially block the slot, and in the open position the slot is not blocked by the second latch portion, and when in the first retaining position the first latch portion is located between the first end and the first release position, and when in the second retaining position the second latch portion is located between the second end and the second release position, and movement of the first engagement surface away from the first release position and away from the first open end causes the second latch portion to move from the second retaining position toward the second open position and causes or urges movement of the first latch portion toward the first retaining position;

movement of the second engagement surface away from the second release position and away from the second open end causes the first latch portion to move from the first retaining position toward the first open position and causes or urges movement of the second latch portion toward the second retaining position; and when one of the first and second latch portions is between the respective open and retaining positions, the other of the first and second latch portions extends into the respective first or second slot.

2. The retention system of claim 1 wherein one of the mounting and retaining members comprises a mating portion having a first surface and a second surface, the other of the mounting and retaining members having at least one first portion that engages the first surface and at least one second portion that engages the second surface.

3. The retention system of claim 2 wherein said mating portion comprises at least one annular ring portion centered on the axis.

4. The retention system of claim 3 wherein said mating portion comprises an opening and the other of the mounting and retaining member extends through the opening.

5. The retention system of claim 3 including at least one securing portion that engages one or both of the first and second surfaces, the securing portion and/or the mating portion being deflectable to allow the at least one securing portion to pass through the opening.

6. The retention system of claim 5 wherein the at least one securing portion comprises two diametrically opposed securing portions.

7. The retention system of claim 5 wherein the at least one securing portion comprises two spaced apart wall portions or are attached to two spaced apart wall portions.

8. The retention system of claim 7 wherein the two spaced apart wall portions are deflectable to allow the at least one securing portion to pass through the opening.

9. The retention system of claim 8 wherein the two spaced apart wall portions are angled toward each other.

10. The retention system of claim 8 including a cross member that extends between the two spaced apart wall portions to limit or prevent deflection.

11. The retention system of claim 1 wherein:

the mounting member comprising a mating member having an opening, a first annular surface on one side of the opening and a second annular surface on the other side of the opening, and the retainer member comprises two spaced apart wall portions, each wall portions engaging the first annular surface and having a securing member that extends through the opening and extends over and engages the second annular surface;

the detent formed by at least one first detent member on at least one securing member that engages at least one second detent member on the second annular surface.

12. The retention system of claim 10 wherein each spaced apart wall portion has first and second ends that engage one of the first and second surfaces and at least one securing portion extends transversely from each spaced apart wall portion intermediate the first and second ends that engages the other of the first and second surfaces.

* * * * *